US005181190A

United States Patent [19]

Kanzaki

[11] Patent Number: 5,181,190

[45] Date of Patent: Jan. 19, 1993

[54] ANALOG ELECTRONIC TIMEPIECE

[75] Inventor: Takashi Kanzaki, Akishima, Japan

[73] Assignee: Casio Computer Co., Ltd., Tokyo, Japan

[21] Appl. No.: 798,697

[22] Filed: Nov. 26, 1991

[30] Foreign Application Priority Data

Nov. 30, 1990 [JP] Japan ..... 2-336742

[51] Int. Cl.[5] ..... G04C 21/00; G04C 19/00

[52] U.S. Cl. ..... 368/76; 368/80; 368/82; 368/228

[58] Field of Search ..... 368/41-43, 368/76, 80, 82, 223, 228

[56] References Cited

U.S. PATENT DOCUMENTS 4,043,116 8/1977 Schlappi .
4,396,294 8/1983 Yoshida .
4,413,915 11/1983 Besson .
4,470,708 9/1984 Nee .
4,488,818 12/1984 Saurer et al. .
4,697,931 10/1987 Okuyama et al. .

FOREIGN PATENT DOCUMENTS 1921563 10/1970 Fed. Rep. of Germany .
2247258 4/1973 Fed. Rep. of Germany .
1-91291 6/1989 Japan .
1-242987 9/1989 Japan .
2052115 1/1981 United Kingdom .

*Primary Examiner*—Vit W. Miska
*Attorney, Agent, or Firm*—Frishauf, Holtz, Goodman & Woodward

[57] ABSTRACT

An analog electronic time piece includes a dial plate in which two openings are formed, two electric-optical display panels arranged below the openings, and a shutter plate rotatably arranged between the dial plate and the display panels. There two openings are closed by the shutter when it is rotated to a first position. One of the two openings is closed and the other is opened by the shutter when it is rotated to a second position. The above described one opening is opened and the other is closed by the shutter when it is rotated to a third position. The two openings are opened by the shutter when it is rotated to a fourth position.

28 Claims, 17 Drawing Sheets

M=O(SR;O)

M=1(SR;15)

M=2(SR;30)

M=3(SR;45)

M=0 (SR;0)

M=1(SR;30 OR 45)

M=2 (SR;15)

ANALOG ELECTRONIC TIMEPIECE

BACKGROUND OF THE INVENTION

1. Field of the Invention

This invention relates to an analog electronic timepiece capable of not only indicating the current time but also displaying information concerning other than the current time.

2. Description of the Related Art

In an attempt to offer multifunctional analog electronic timepieces, there have been proposed a variety of analog electronic timepieces provided with an electric display device such as a liquid crystal display device and capable of displaying alternatively a date information, an alarm time information, a stopwatch measuring time information, a schedule information, a telephone number information, and so on.

However, any of these known electronic timepieces have a drawback that its display surface of the display device is constantly exposed even when there is no need to display information there on, so that its appearance is deteriorated.

To avoid this problem, Published Unexamined Japanese Patent Application No. 1-242987 and Published Unexamined Japanese Utility Model Application No. 1-91291 propose an analog electronic timepiece provided with a dial plate having an opening, a liquid crystal display device arranged below the opening, and a shutter plate arranged between the opening of the dial plate and the liquid crystal display device to selectively open and close the opening in such a manner that the shutter plate is displaced by a pulse motor operated by means of a switch only when information is displayed on the liquid crystal display device.

A timepiece as described above, however, needs to have a large electric-optical display device capable of displaying a relatively large number of figures or letters if plural time informations or an information which requires a large number of display digits for displaying the information should be displayed at a time. Since the size of the electric-optical display device that can be installed in a small electronic time-piece such as a wrist watch is limited, not only the size of each display digit but also an interval between the adjacent display digits will be inevitably very small if a large number of display digits are mounted in the small timepiece. Therefore, more than two informations simultaneously displayed on such display device is hardly readable and tend to be mislead.

On the other hand, if an information requiring a few number of display digits when it is displayed on the display device is displayed on such display device, unused display digits are included in a large area in the display device so that the appearance of the time-piece is deteriorated.

SUMMARY OF THE INVENTION

The object of the present invention is to provide an analog electronic timepiece which is capable of displaying information other than the current time and can not only readably display more than two informations or an information requiring a large number of display digits when it is displayed on the display device so that misleading of such information or informations is effectively prevented, but also prevent the appearance of the timepiece from being injured even when one of more than two informations or an information requiring a few number of display digits when it is displayed on the display device is displayed.

According to the invention, the above object of the invention is achieved by providing an analog electronic timepiece comprising: a dial plate in which at least two openings are formed; time-indicating hand means for pivotally moving hands on the dial plate to indicate the time; at least two electric-optical display means mounted below the dial plate to correspond to the openings; a single shutter plate rotatably mounted between the dial plate and the electric-optical display means; and shutter-plate movement control means for controlling the movement of the shutter plate; wherein the single shutter plate is formed in such a shape that it opens all the openings of the dial plate when the dial plate is located at its first position in its rotational direction, closes all the openings of the dial plate when the dial plate is located at its second position in its rotational direction, opens at least one of the openings and closes at least one of the remaining ones of the openings when the shutter plate is located at its third position in its rotational direction.

With such an arrangement, more than two informations or an information requiring a large number of display digits when it is displayed on the display device may be displayed separately to be readily read and prevented from being mislead. Moreover, since only the display digit or display digits needed to display information is or are exposed and the other display digits not required for displaying information are invisible, the timepiece can constantly keep its good appearance.

Now, the present invention will be described in greater detail by referring to the accompanying drawings that illustrate preferred embodiments of the invention.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

(1) 1st Embodiment

A first embodiment of the invention will be described by referring to FIGS. 1 through 9. This embodiment is an electronic wrist watch.

(a) Construction

Figure 1:
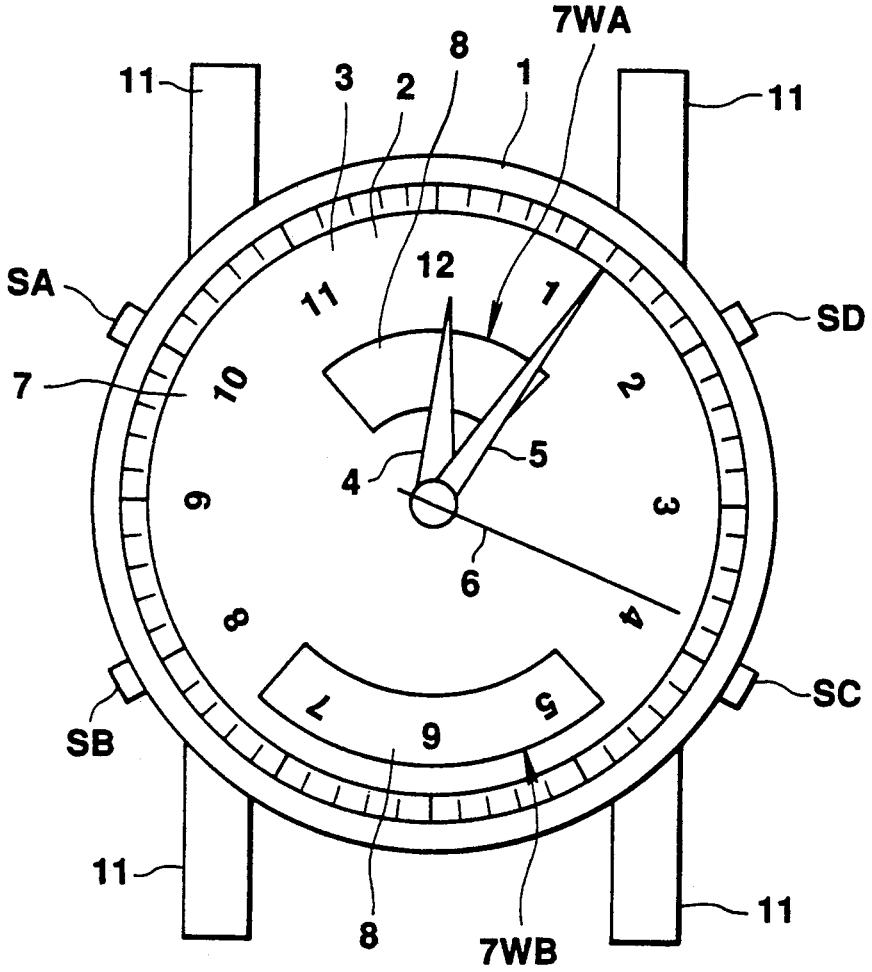
FIG. 1 is a plan view of an electronic wrist watch of a first embodiment of the invention with its two openings being closed by a shutter plate.

Referring firstly to FIG. 1 showing an outside view of the embodiment, a watch case 1 has on its front surface a hand display portion 3 covered by a watch glass 2. The hand display portion 3 includes an hour hand 4, a minute hand 5, a second hand 6 and a dial plate 7. The dial plate 7 is provided with two openings or display window portions 7WA, 7WB, each of which has a width-wide circular arc shape with a central angle of substantially 90° around a pivotal center of the hands. Liquid crystal display panels 10*a*, 10*b* (not shown), each having substantially the same shape (a width-wide circular arc shape with a central angle of substantially 90° C.) as that of the corresponding each display window portion 7WA, 7WB, are arranged below the display window portions 7WA, 7WB so as to be visible only under certain conditions which will be described later. Figures of 5, 6 and 7 for indicating respectively five o'clock, six o'clock and seven o'clock, are not printed on the dial plate 7, and the display window portion 7WB is provided in the portion of the dial plate 7 on which these figures are usually printed. A disc-like shutter plate 8 which is rotatable around the pivotal center of the hands is arranged at a position located behind the dial plate 7 but in front of the liquid crystal display panels 10*a*, 10*b*. The shutter plate 8 is provided with openings described later and a mask portion. These openings are located below the display window portions 7WA and 7WB to expose the liquid crystal display panels 10*a*, 10*b* to make them visible from outside when the shutter plate 8 is turned. The figures of 5, 6 and 7 for indicating five o'clock, six o'clock and seven o'clock are printed on the mask portion of the shutter plate 8, and they are placed under the display window portion 7WB to make them visible from outside when the shutter plate 8 is turned to cover the display window portion 7WB by the mask portion.

The watch case 1 is also provided with four push button switches SA through SD and band attaching portions 11 on its outer periphery.

The surface of the shutter plate 8 and that of the dial plate 7 have an identical color so that the display window portions 7WA, 7WB may hardly be recognized when they are closed by the shutter plate 8 as shown in FIG. 1.

Figure 2:
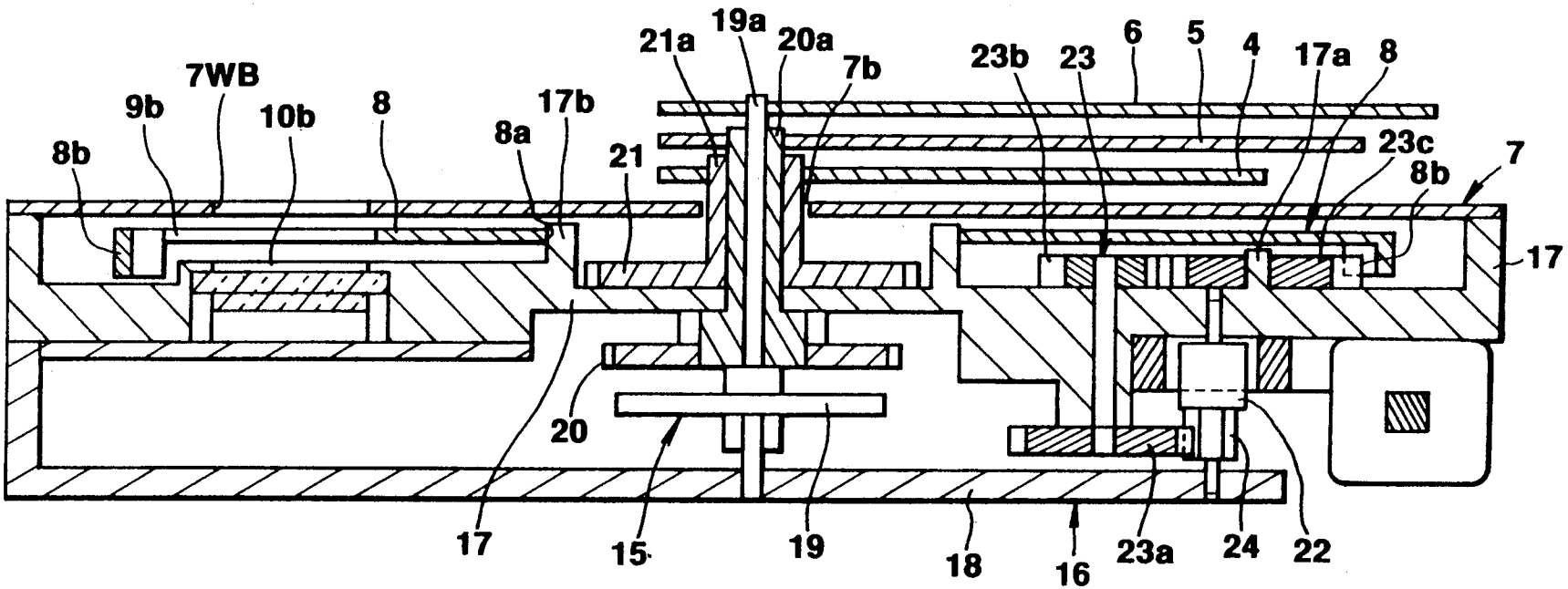
FIG. 2 is a sectional view of showing a main portion of the electronic wrist watch of FIG. 1.

FIG. 2 shows a main portion of an analog movement within the watch case 1. The analog movement is used to drive the hour hand 4, the minute hand 5 and the second hand 6 to indicate the current time, and is constructed by a gear train mechanism 15 and a shutter opening/closing device 16. The gear train mechanism 15 is driven by a hand drive stepping motor (not shown) to drive the hands, and includes a second wheel 19 rotatably mounted between a main plate 17 and a bearing plate 18, a center wheel 20 rotatably attached to a shaft 19*a* of the second wheel 19, and an hour wheel 21 rotatably attached to a projected end of a tubular shaft 20*a* of the center wheel 20 projecting upwardly from the main plate 17. The second wheel 19 is driven by the stepping motor by way of a intermediate wheel (not shown) to drive the second hand 6 attached to a projected end of the shaft 19*a* projecting upwardly from the main plate 17. The center wheel 20 is used to drive the minute hand 5 attached to a projecting end of the tubular shaft 20*a* projecting upwardly from the main plate 17 and carrying the minute hand 5 at the top. The rotary movement of the second wheel 19 is transmitted to the center wheel 20 by way of a third wheel (not shown) to drive the minute hand 5. The hour wheel 21 is used to drive the hour hand 4 attached to an upper end of its tubular shaft 21*a*. The rotary movement of the center wheel 20 is transmitted to the hour wheel 21 by way of a minute wheel (not shown) to drive the hour hand 4.

The shutter opening/closing device 16 is designed to drive the shutter plate 8 to rotate around the pivotal center of the hands, and includes a shutter drive stepping motor 22 and a gear train mechanism 23. The gear train mechanism 23 is constructed by a first gear wheel 23*a* engaged with a rotor pinion 24 of the shutter drive stepping motor 22, a second gear wheel 23*b* fixed to the shaft of the first gear wheel 23*a*, and a third gear wheel 23*c* rotatably attached to a projection 17*a* of the main plate 17 and engaged with the second gear wheel 23*b*.

The dial plate 7 is fixed to the main plate 17, and the shutter plate 8 is rotatably arranged under the dial plate 7. The liquid crystal display panels 10*a* and 10*b* (not shown) are located below the shutter plate 8, an upper surface of each of the liquid crystal display panel has a width-wide circular arc shape with a central angle of substantially 90°. The dial plate 7 has a central through hole 7*b* for receiving the tubular shaft 21*a* of the hour wheel 21, and the two display window portions 7WA, 7WB that have substantially the same shape as those of the liquid crystal display panels 10*a*, 10*b* are located exactly above the display panels. The shutter plate 8 is used to selectively open and close the display window portions 7WA, 7WB as it is removed from and located above the liquid crystal display panels 10*a*, 10*b*, and has a disc-like shape provided with a central through hole 8*a* for receiving the projecting portion 17*b* of the main plate 17 and a notch portion 9*b* which will be described later. An internal gear 8*b* is mounted on the outer peripheral portion of the lower surface of the shutter plate 8, and is engaged with the third gear wheel 23*c* described above. Thus, when the shutter drive stepping motor 22 is operated, its rotary force is transmitted to the internal gear 8*b* by way of the rotor pinion 24, the first gear wheel 23*a*, the second gear wheel 23*b* and the third gear wheel 23*c* to rotate the shutter plate 8 to open or close the display window portions 7WA, 7WB.

Figure 3:
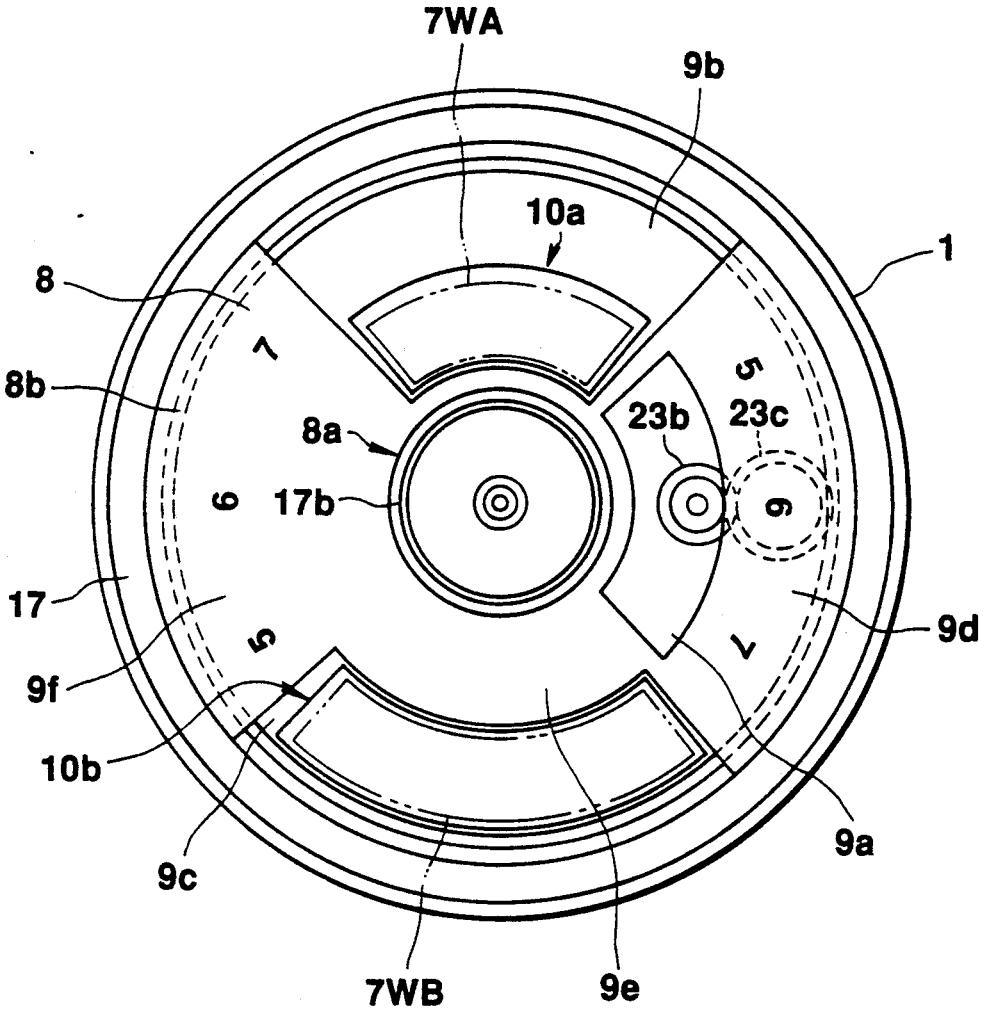
FIG. 3 is a plan view of a shutter plate drive mechanism of the electronic wrist watch of FIG. 1.

FIG. 3 is a plan view of the embodiment, where the hour hand 4, the minute hand 5 and the second hand 6 as well as the dial plate 7 are removed to show in detail the shape of the shutter plate 8 and the positional relationship between the liquid crystal display panels 10*a*, 10*b* and the shutter plate 8. The shutter plate 8 is constructed by four sector portions, each having a central angle of 90°. The width-wide circular arc shaped notch portion 9*b*, which is extending in its width direction from a portion near the center of the shutter plate 8 to the outer peripheral portion thereof, its formed in one of the sector portions.

A sector portion arranged at the right side of the above described one sector portion is provided at its portion near the center thereof with a width-wide circular arc shaped opening 9*a* with a central angle of substantially 90°, and a mask portion 9*d* is provided at a portion near its outer periphery. The above described figures of 5, 6 and 7 are printed on the surface of the mask portion 9*d* at intervals of a center angle of substantially 30°. A sector portion arranged at the left side of the sector portion in which the notch portion 9*b* is formed is provided with a mask portion 9*f*, and figures of 5, 6, and 7 are printed on the outer peripheral portion of the mask portion 9*f* at intervals of substantially 30°, as the same as the case of the mask portion 9*d*.

A sector portion arranged opposingly to the sector portion in which the notch potion 9*b* is formed is provided at a portion near its outer peripheral portion with a width-wide circular arc shaped notch portion 9*c* with a central angle of substantially 90°, and a mask portion 9*e* is formed at a portion rear the center thereof.

The shutter plate 8 formed as described above is arranged in the watch case so that the projecting portion 17*b* of the main plate 17 is inserted into the through hole 8*a*, and is rotatable around the projecting portion 17*b*. The internal gear 8*b* arranged on the outer peripheral portion of the lower surface of the shutter plate 8 engages the above described third gear wheel 23*c*. Therefore, the rotary movement of the shutter drive stepping motor 22 is transmitted to the internal gear 8*b* by way of the rotor pinion 24, the first gear wheel 23*a*, the second gear wheel 23*b* and the third gear wheel 23*c* to rotate the shutter plate 8.

The liquid crystal display panels 10*a*, 10*b* between the shutter plate 8 and the main plate 17 are respectively located at a position near the center on the twelve o'clock line and at a position near the outer peripheral portion on the six o'clock line. The liquid crystal display panel 10*a* becomes entirely visible when either the opening portion 9*a* or the notch portion 9*b* of the shutter plate 8 is placed exactly under the display window portion 7WA by the rotary movement of the shutter plate 8, whereas the liquid crystal display panel 10*b* is made wholly visible when either the notch portion 9*b* or 9*c* of the shutter plate 8 is placed under the display window portion 7WB.

In the following description, rotational angle of the shutter plate 8 will be expressed by 0 when the opening portion 9*a* is located exactly on the six o'clock line and the liquid crystal display panel 10*b* is completely covered by the mask portion 9*d*, and the rotational angle is increased when the shutter plate 8 rotates counterclockwise. (Note that the shutter plate 8 rotates only counterclockwise and it never rotates clockwise.)

Figures 4, 5:
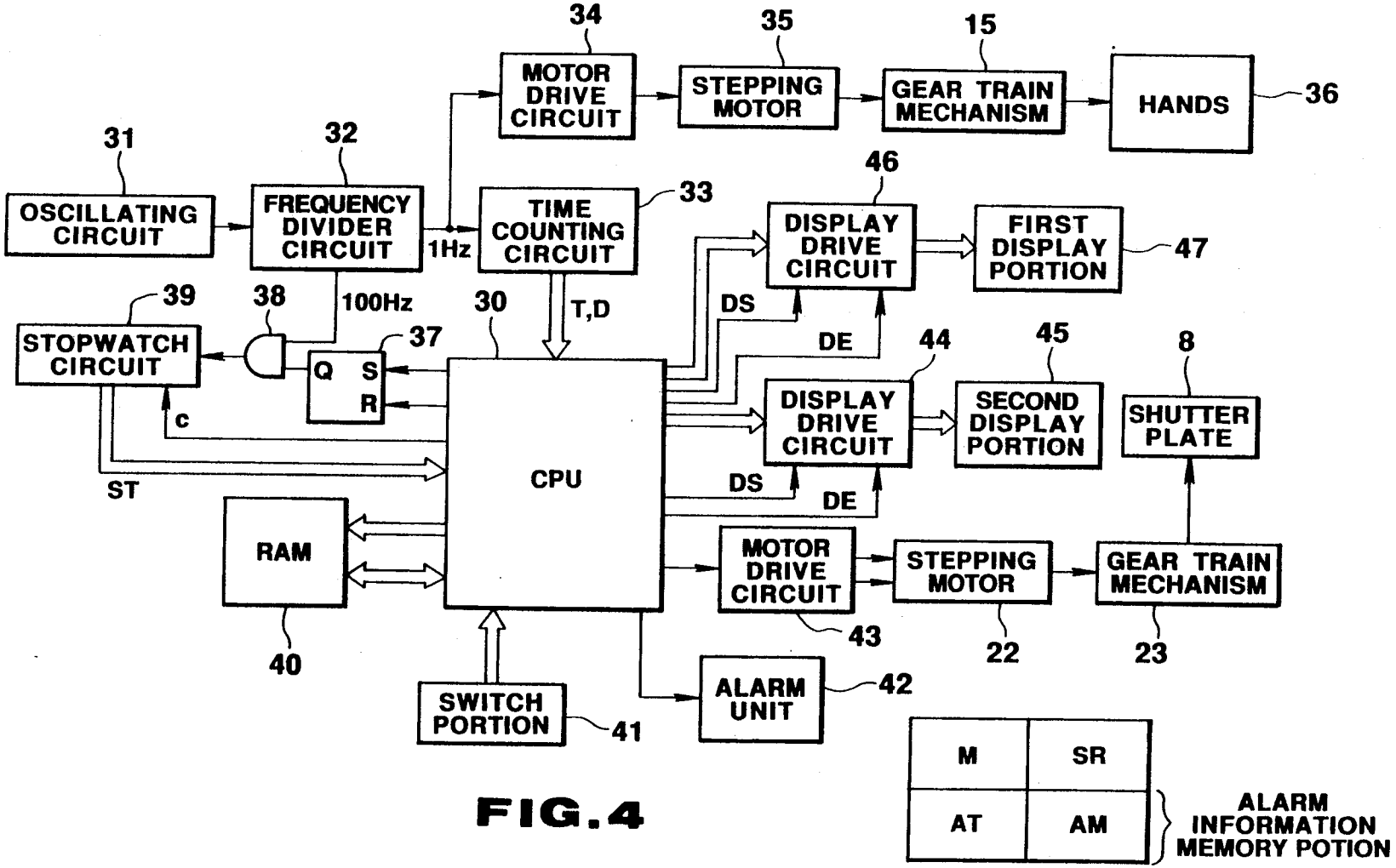
FIG. 4 is a block diagram showing a circuit construction of the electronic wrist watch of FIG. 1.
FIG. 5 is a schematic view of a construction of a RAM 40 of FIG. 4.

FIG. 4 shows a circuit construction of this embodiment. Here, all circuits portions are arranged around a CPU 30 and connected thereto. The CPU 30 processes data supplied thereto and transmits the processed data and further supplies signals to the respective circuit portions to control them.

An oscillating circuit 31 is a circuit that regularly sends out a signal of a predetermined frequency. A frequency divider circuit 32 divides the signal from the oscillating circuit 31 to produce a 100 Hz signal and a 1 Hz signal. The 100 Hz signal is sent to an AND-gate 38, and the 1 Hz signal is sent to a time counting circuit 33 and a motor drive circuit 34. The time contouring circuit 33 counts the number of 1 Hz signals from the frequency divider circuit 32 to obtain the current time T and date D, and sent them to the CPU 30.

The motor drive circuit 34 receives the 1 Hz signal from the frequency divider circuit 32 and drives a stepping motor 35. The stepping motor 35 driven by the motor drive circuit 34 transmits its rotary force to the hands 36 by way of the gear train mechanism 15 to move the hands 36.

An RS flip-flop 37 is a circuit which becomes a set condition when it receives a set signal from the CPU 30 and outputs output signals Q, and which becomes a reset condition when it receives a reset signal from the CPU 30 under the set condition to stop the outputting transmission of the output signals Q. The AND-gate 38 is opened when it receives the output signal Q from the RS flip-flop 37 to transmit the 100 Hz signal from the frequency divider circuit 32 to a stopwatch circuit 39. The stopwatch circuit 39 counts the number of 100 Hz signals supplied from the AND-gate 38 in a later described stopwatch mode to determined an elapsed time ST from the start of the counting process, and sents the elapsed time ST to the CPU 30. The stopwatch circuit 32 clears the elapsed time ST when it receives a clear signal C from the CPU 30.

An RAM 40 is a circuit portion to store data from the CPU 30 and send back any of the store data under the control of the CPU 30. A switch portion 41 includes the push button switches SA through SD, and transmits a switch ON signal to the CPU 30 at each time one of the switches is depressed. An alarm unit 42 includes a circuit for generating an alarm sound upon receiving a specific signal from the CPU 30.

A motor drive circuit 43 is a circuit for driving the shutter drive stepping motor 22 by a predetermined angle at each time it receives a specific signal from the CPU 30, and the rotary force of the shutter drive stepping motor 22 is transmitted to the shutter plate 8 by way of the gear train mechanism 23 so that the shutter plate 8 is rotated counterclockwise by 6° (or 360°/60 steps) at each time the CPU 30 transmits a signal to the motor drive circuit 43. A display drive circuit 44 starts driving a second display portion 45 to display data transmitted from the CPU 30 on the liquid crystal display panel **10*b* when it receives a display start signal DS from the CPU 30, and stops driving the second display portion 45 to terminate the displaying action when it receives a display stop signal DE from the CUP 30. Likewise, a display drive circuit 46 starts driving a first display portion 47 to display data transmitted from the CPU 30 on the liquid crystal display panel 10*a* when it receives the display start signal DS from the CPU 30, and stops driving the first display portion 47 to terminate the displaying action when it receives the display stop signal DE from the CUP 30**.

FIG. 5 shows a construction of the RAM 40. Here, a mode register M is used to specify a mode of action. When 0 is set in the resister M, it designates a watch mode, in which both of the display window portions 7WA, 7WB are closed by the shutter plate 8 and only the current time is indicated by the hands 36 until the current time becomes consistent with the scheduled time. When 1 is set in the mode register M, it designates an alarm display mode, in which both of the display window portions 7WA, 7WB are opened and the liquid crystal display panels **10*a*, 10*b* display an alarm time and an alarm message stored in an alarm time memory AT and in an alarm message memory AM of an alarm information storage portion A, which will be described later. When 2 is set in the mode register M, it designates a date display mode, in which only the display window 7WA is opened and the current date is displayed on the liquid crystal display panel 10*a***. Finally, if 3 is set in the mode register, it designates a stopwatch mode, in which the watch of this embodiment functions as a stopwatch.

A shutter position register SR is a register in which the step number corresponding to the rotational angle of the shutter plate 8 as defined earlier is set. The step number of 0 is set therein when the rotational angle of the shutter plate 8 is 0, and thereafter the step number is increased by one at each time the shutter plate 8 rotates in a forward direction by 6°, or the rotational angle thereof increases by 6° (Thus, the step number is 15 when the rotational angle of the shutter plate is 90°, it is 30 when the rotational angle is 180°, and it is 45 when the rotational angle is 270°.). The alarm information storage portion A is constructed by the alarm time memory AT and the alarm message memory AM, which respectively store a time and a message relating to one schedule.

(b) Action

The action of the first embodiment constructed as described above will be explained in the followings.

Figure 6:
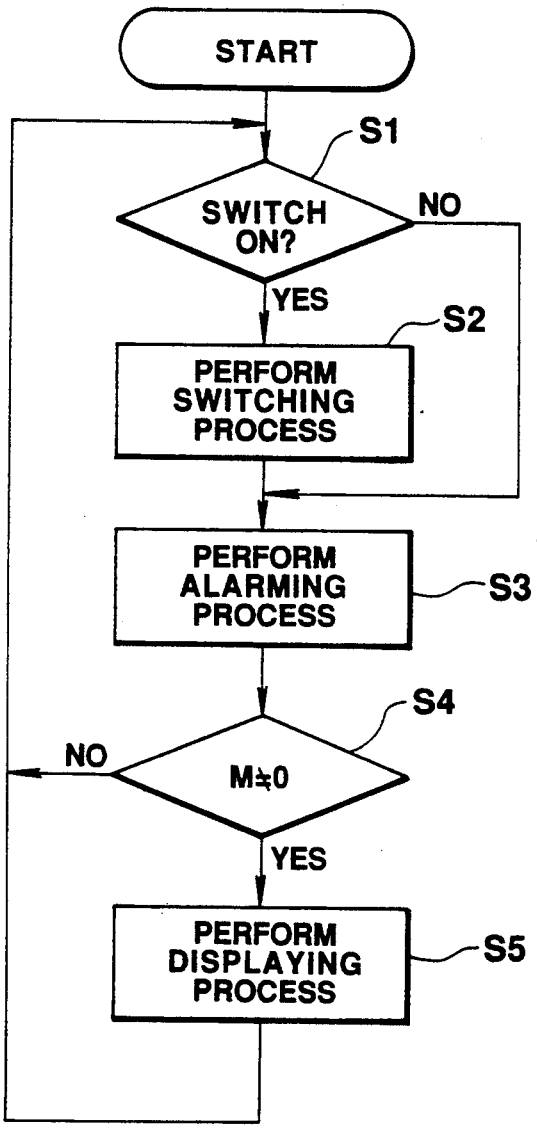
FIG. 6 is a general flow chart illustrating an action of the circuit of FIG. 4.

FIG. 6 is a general flow chart schematically illustrating the overall action of the embodiment. In a step S1, the CPU 30 checks if one of the switches is depressed or not. If yes, the action proceeds to a step S2, where a process is carried out for the depressed switch, and then proceeds to a step S3 for an alarming process. If it is determined in the step S1 that no switch is depressed, the action goes directly to the step S3 for the alarming process. In the alarming process, the CPU 30 checks if the current time T and date D transmitted from the time counting circuit 33 are consistent with an alarm time and date stored in the alarm information storage portion A. If yes, it causes the shutter plate 8 to rotate to open the display window portions 7WA, 7WB, and causes the liquid crystal display panels **10*a*, 10*b* to display the alarm time and date and the alarm message, further at the same time it transmits a signal to the alarm unit 42 to make it generate an alarm sound for a predetermined period of time. Then in a step S4, if a number other than 0 is set in the mode register M or not and a mode other than a watch mode is set or not. If the mode other than the watch mode is set, the action proceeds to a step S5, where it executes a displaying process for displaying various data on the liquid crystal display panels 10*a*, 10*b*, and then the action returns to the step S1. On the other hand, if the mode set in the mode register is the watch mode, or M=0, the action directly goes back to the step S1** and follows again the same processes.

Figure 7:
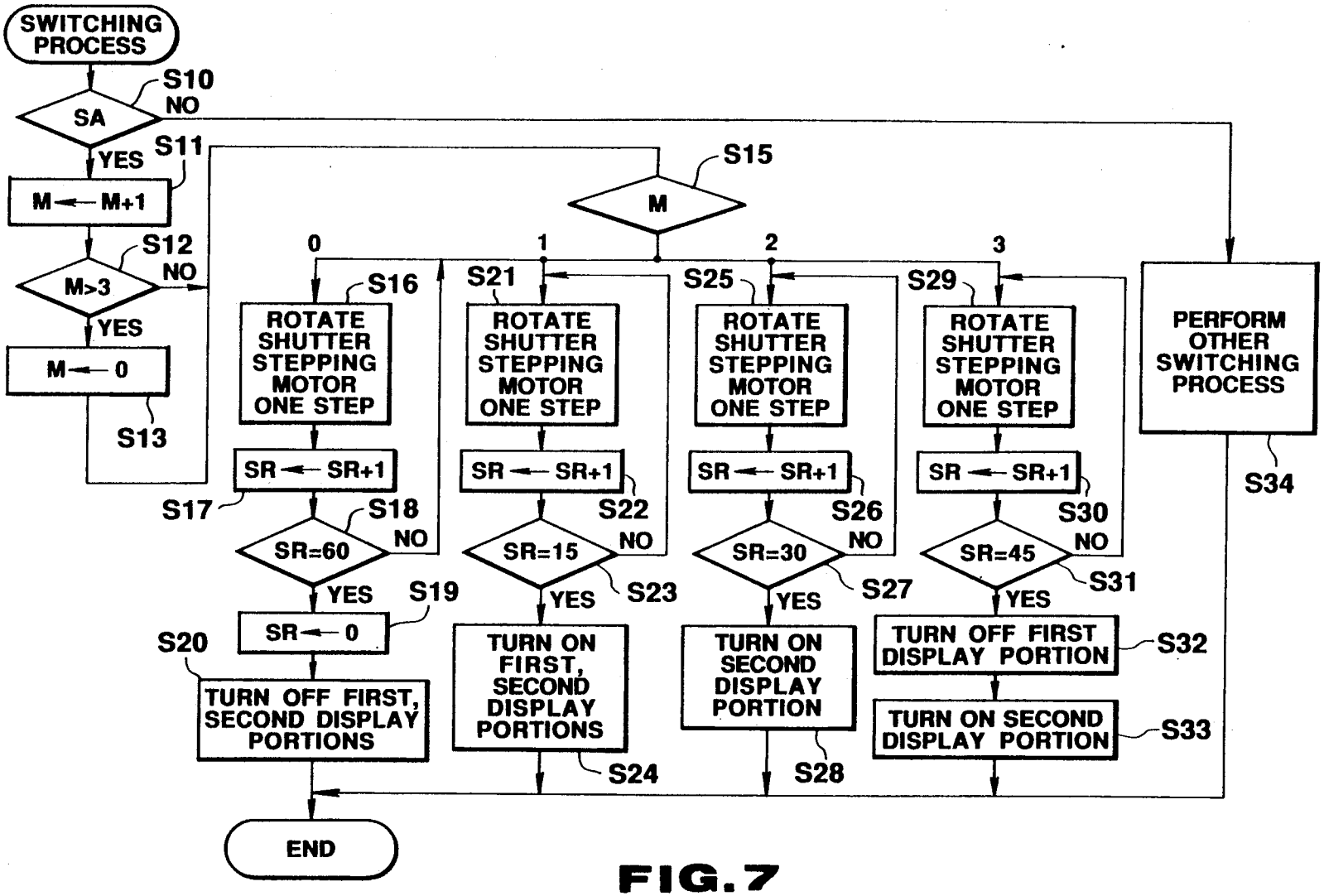
FIG. 7 is a flow chart illustrating in detail a switching process in the flowchart of FIG. 6.
Figure 8:
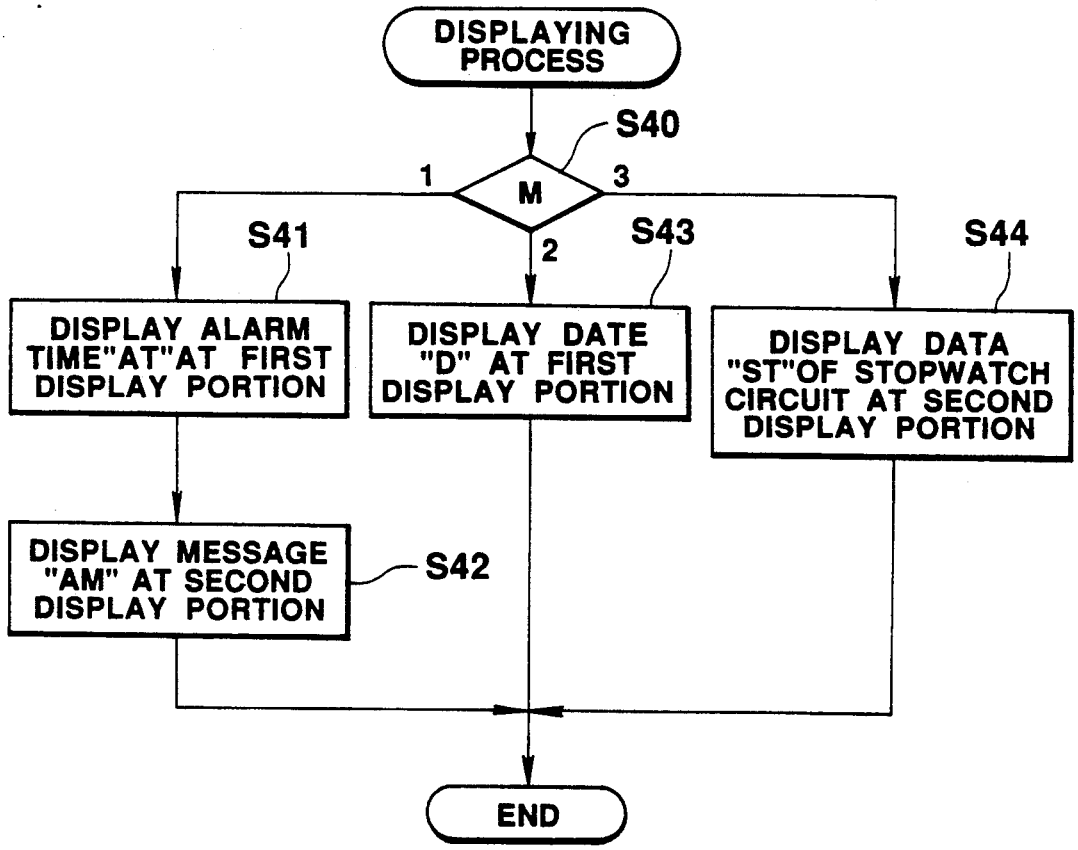
FIG. 8 is a flow chart illustrating in detail a displaying process in the flowchart of FIG. 6.

FIG. 7 is a flow chart illustrating in detail the switching process (in the step S2), and FIG. 8 is a flow chart illustrating in detail the displaying process (in the step S5).

Figure 9A:
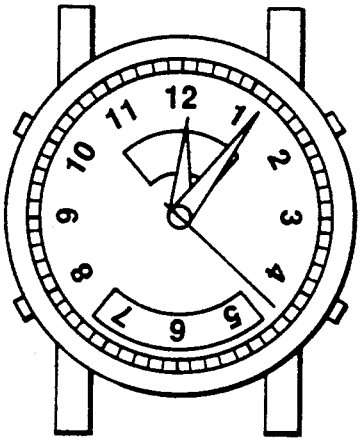
FIG. 9A is a plan view of the electronic wrist watch of FIG. 1 with its two openings being closed by the shutter plate as shown in FIG. 1.

Assume that 0 is set in the mode register M for the watch mode and 0 is set in the shutter position register SR (meaning that the rotational angle of the shutter plate 8 is 0°), and that both of the display window portions 7WA, 7WB are closed by the mask portions **9*f*, 9*e* as illustrated in FIG. 9A. Under this condition, the fact that no switch is depressed is confirmed in the step S1 so long as there is no depressed switch, and the alarming process is carried out in the step S3 as described earlier. Then in the step S4, the fact that 0 is set in the mode register M and the watch mode is set is confirmed, and the action returns to the step S1** and follows again the same process.

If, now, the push button SA is depressed, the watch mode is switched to the alarm display mode and the alarm information stored in the alarm information storage portion A can be visually confirmed. The depressed condition of the switch SA is detected in the step S2 where the switching action is carried out, or detected in a step S10 of the flow chart of FIG. 7, and then, in a step S11, the value in the mode register M is increased by one to become 1. Then, in a step S12, that the value in the mode register M does not exceed 3 is determined, and the action proceeds to a step S15, where it is determined that value in the mode register M is equal to 1, representing the alarm display mode, and the action proceeds to a step S21, where the CPU 30 transmits a signal to the motor drive circuit 43 to drive the shutter drive stepping motor 22 and therefore rotate counterclockwise the shutter plate 8 by one step (or 6° as described earlier). Then, in a step S22, the value stored in the shutter position register SR is increased by one, and, in a step S23, it is determined that the value of the shutter position register SR has not reached 15 yet. Thereafter, the action returns to the step S21. Then, the processes from the steps S21 through S23 are repeated until the value stored in the shutter position register SR becomes equal to 15. When the value of the shutter position register SR has become equal to 15 and the shutter plate 8 has rotated couterclockwise by 90°, the notched portion 9*b* of the shutter plate 8 is exactly placed above the display window portion 7WA to completely expose the liquid crystal display panel 10*a*, and the notched portion 9*c* is exactly placed above the display window 7WB to expose the liquid crystal display panel 10*b*. This condition is detected in the step S23, and the action proceeds to a step S24, where the CPU 30 transmits the display start signal DS to the display drive circuits 44 and 46 to make both the liquid crystal display panels 10*b*, 10*a* of the second and first display portions 45, 47 being in a display standby condition, and the action proceeds to the step S3 of FIG. 6.

Figure 9B:
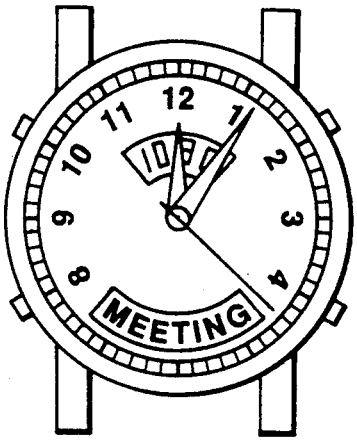
FIG. 9B is a plan view of the electronic wrist watch of FIG. 1 with its two openings being opened.

When, on the other hand, the alarming process is completed in the step S3, it is confirmed in the step S4 that the value in the mode register is not equal to 0 and the watch mode is not set, and then, in the step S5, the action performs the displaying process. Then, referring to FIG. 8, it is determined in a step S40 that the value in the mode register M is equal to 1 and the alarm display mode is set, and then, in a step S41, an alarm time stored in the alarm time memory AT is displayed on the liquid crystal display panel 10*a*. In a step S42, an alarm message stored in the alarm message memory AM is displayed on the liquid crystal display panel 10*b*. If the alarm information stored in the alarm information storage portion A is a meeting starting at 10:30, this information will be displayed on the liquid crystal display panels 10*a*, 10*b* as shown in FIG. 9B.

The alarm display mode is switched to the date display mode by depressing the push button switch SA. Then, the action proceeds to the step S2, where the switching process in FIG. 7 is carried out. The fact that the push button switch SA is depressed is detected in the step S10, and the value in the mode register M is increased by one in the step S11 to select the date display mode. Thereafter, in the step S12, it is determined that the value in the mode register does not exceed 3, and the action proceeds to the step S15, where that the value in the mode register M is already 2 and the date display mode is selected is determined. Then, the action proceeds to a step S25, where the CPU 30 sents a signal to the motor drive circuit 43 to make the shutter drive stepping motor 22 rotate by one step to rotate the shutter plate 8 by one step (6°). Then, in a step S26, the value stored in the shutter position register SR is increased by one to register the rotation of the shutter plate 8, and the action proceeds to a step S27, where it is determined that the value in the shutter position register has not reached 30 yet, and then the action returns to the step S25. Thereafter, the processes from the steps S25 through S27 are repeated until the value in the shutter position register SR becomes equal to 30.

Figure 9C:
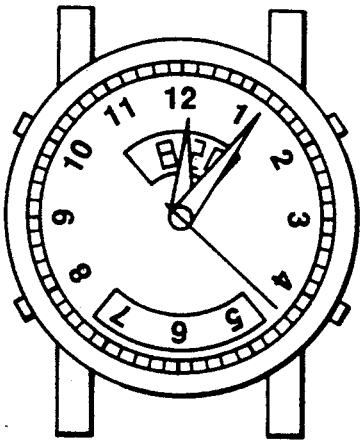
FIG. 9C is a plan view of the electronic wrist watch of FIG. 1 with only one of the openings being opened and the other being closed by the shutter plate.

When it is determined in the step S27 that the value in the shutter position register SR has reached 30, the shutter plate 8 has rotated by 90° from the position in the alarm display mode so that the opening portion 9*a* of the shutter plate 8 is placed exactly under the display window portion 7WA to completely expose the liquid crystal display panel and another display window portion 7WB is closed by the mask portion 9*f* to expose the FIGS. 5, 6 and 7 printed thereon in the display window 7WB as if these figures will be displays to form five, six, and seven o'clock markers on the dial plate as shown in FIG. 9C. Then, the action goes to a step S28, where the display start signal DS is transmitted to the display drive circuit 44 to make the liquid crystal display panel 10*b* of the second display portion 45 be in a stand-by condition for the displaying action, and then the switching process is terminated. Then, the action goes to the step S3 of FIG. 6, where the alarming process is carried out in a manner as described earlier, and then the action goes to the step S4, where it is determined that the value in the mode register M is not 0 any more and a mode other than the watch mode has been selected, and further the action proceeds to the step S5 of FIG. 8 for the displaying process. Then, in the step S40, that the value in the mode register M is equal to 2 is determined, and then, in a step S43, the current date D is displayed on the liquid crystal display panel 10*a*, and the action goes back to the step S1. If the current date is August 20th, the display on the liquid crystal display panel 10*a* will look as shown in FIG. 9C.

Figure 9D:
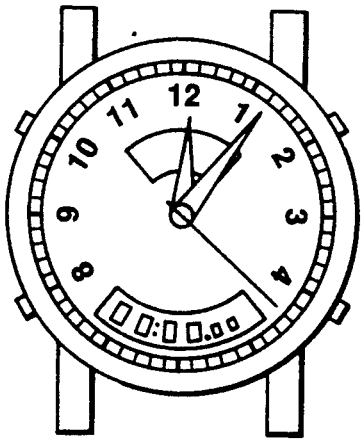
FIG. 9D is a plan view of the electronic wrist watch of FIG. 1 with one opening shown in FIG. 9C being closed and the other opening shown in FIG. 9C being opened.

The date display mode is switched to the stopwatch mode when the push button switch SA is depressed. Upon detecting in the step S10 of FIG. 7 the fact that the push button switch SA is depressed, the action proceeds to the step S11, where the value in the mode register M is increased by one to become 3 to select the stopwatch mode. Then, in the step S12, it is determined that the value in the mode register M does not exceed 3, and the action goes to the step S15, where it is determined that 3 is set in the mode register M and therefore the stopwatch mode has been selected. Then, in a step S29, the CPU 30 transmits a signal to the motor drive circuit 43 to make the shutter drive stepping motor 22 and therefore the shutter plate 8 rotate by one step and, in a step S30, the value in the shutter position register SR is increased by one. Then, in a step S31, it is determined that the value in the shutter position register SR has not reached 45 yet, and the action returns to the step S29. Thereafter, the processes from the steps S29 through S31 are repeated until the value in the shutter position register SR becomes equal to 45. When it is determined in a step S32 that the value in the shutter position register SR has reached 45, the shutter plate 8 has rotated advanced further by 90° from the position in the date display mode, and the notch portion 9*b* of the shutter plate 8 is placed exactly under the display window portion 7WB to completely open the display window portion 7WB and to expose the liquid crystal display panel 10*b*, while the display window portion 7WA is closed by the mask portion 9*e*. Then, the action goes to the step S32, where the display stop signal DE is transmitted to the display drive circuit 46 to make the liquid crystal display panel 10*a* of the first display portion 47 stop the displaying action, and then the action proceeds to a step S33, where the display start signal DS is transmitted to the motor drive circuit 43 to make the liquid crystal display panel 10*b* of the second display portion 45 being in the stand-by condition for the displaying action. After completion of the switching process, the action proceeds to the step S3 of FIG. 6 to execute the alarming process as described earlier and, after confirming that the value in the mode register M is not equal to 0 and therefore the watch mode is not set, the action proceeds further to the step S5 for the displaying process as illustrated in FIG. 8. In the step S40, it is determined that the value in the mode register M is equal to 3 and the stopwatch mode is selected, and, in a step S44, the elapse of time measured by the stopwatch circuit 39 is displayed on the liquid crystal display panel 10*b* of the second display portion 45. Since the stopwatch counter circuit 39 has not started counting yet and the elapsed time is 0, the liquid crystal display panel 10*b* will look as shown in FIG. 9D.

After the stopwatch mode is selected in a manner as described above, the push button switch SB needs to be depressed to cause the watch of this embodiment to function as a stopwatch. Then, in the step S2 of FIG. 7, the switching is carried out, and after determining that the depressed push button switch is not the push button switch SA in the step S10, the action proceeds to a step S34, where it is detected that the depressed push button switch is the push button switch SB. The set signal is transmitted to the RS flip-flop 37, and, upon receiving an output Q from the RS flip-flop 37 the AND-gate 38 is opened to cause the frequency divider circuit 32 to send the 100 Hz signal to the stopwatch circuit 39, whereby the circuit 39 starting the stopwatch time measuring process. Thereafter, the stopwatch circuit 39 continually sends out an elapsed time ST, and the elapsed time ST is displayed on the liquid crystal display panel 10*b* in the step S44 for the displaying process as illustrated in FIG. 8. The time measurement as the stopwatch is terminated when the push button switch SB is further depressed. Then, in the step S34, the reset signal is sent to the RS flip-flop 37 and sending out of the output Q from the RS flip-flop 37 is stopped to close the AND-gate 38, so that the 100 Hz signal is not sent to the stopwatch circuit 39 any more. Therefore the elapsed time ST coming from the stopwatch circuit 39 does not change, the elapsed time when the stopwatch time measuring process was terminated have being displayed on the liquid crystal display panel 10*b*. The elapsed time ST registered in the stopwatch circuit 39 is cleared by depressing the push button switch SC. In this case, in the step S34 for the switching process, a clear signal C is sent to the stopwatch circuit 39, and the circuit 39 reduces the elapsed time ST to 0 so that the time displayed on the liquid crystal display panel 10*b* becomes 0.

Under this condition, the stopwatch mode set in the mode register M is switched to the watch mode when the push button switch SA is depressed. As the switch SA is depressed, the action goes to the step S2 of FIG. 7, and, in the step S10, the fact that the push button switch SA is depressed is detected. Then, in the step S22, the value in the mode register M is increased by one to become 4 and, in the step S12, it is determined that the value in the mode register M exceeds 3. The action then goes to a step S13, where the value in the 10 mode register M is reduced to 0 to set the watch mode. Then, in the step S15, it is determined that the value in the mode register M is already 0 and the watch mode is selected. In a step S16, the CPU 30 sends a signal to the motor drive circuit 43 to rotate the motor drive stepping motor 22 and hence the shutter plate 8 in the forward direction (counterclockwise) by one step, and, in a step S17, the value of the shutter position register SR is increased by one. Then, in a step S18, that the value in the shutter position register SR has not reached 60 yet is determined, and the action returns to the step S16. Thereafter, the processes from the steps S16 through S18 are repeated until the value in the shutter position register SR becomes equal to 60. The fact that the value in the register SR is 60 and the display window portions 7WA, 7WB are closed by the mask portions 9*f* and 9*d* is detected in the step S18, and the action goes to a step S19, where the value in the shutter position register SR is reduced to 0. Thereafter, in a step S20, the CPU 30 sends out the display stop signal DE to both of the display drive circuits 46 and 44 to wipe out the displays on the liquid crystal display panels 10*a*, 10*b* of the first and second display portions 47, 45. Then, the action goes to the step S3 of FIG. 3, where the alarming process is carried out in a manner as described above to determine that the value in the mode register M is 0 and the watch mode is set, and further the action goes back to the step S1.

Figure 10:
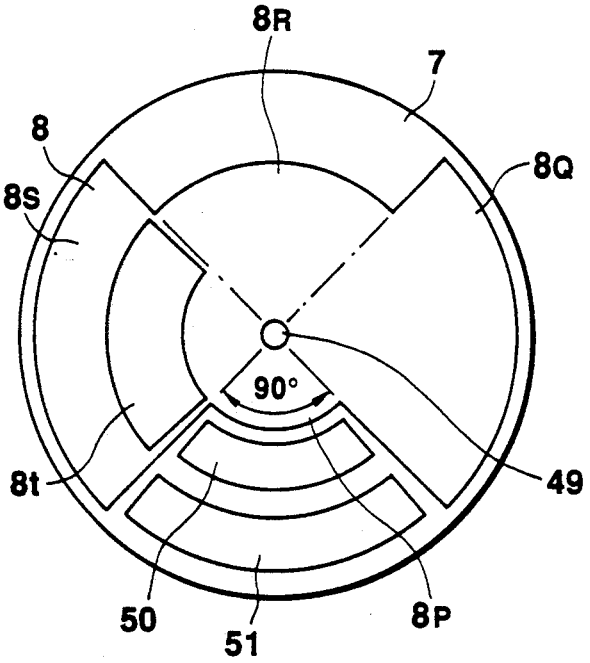
FIG. 10 is a plan view showing a shape of a shutter plate and a positional relationship between the shutter plate and display openings of a dial plate in a modification of the first embodiment of the invention.
Figure 11:
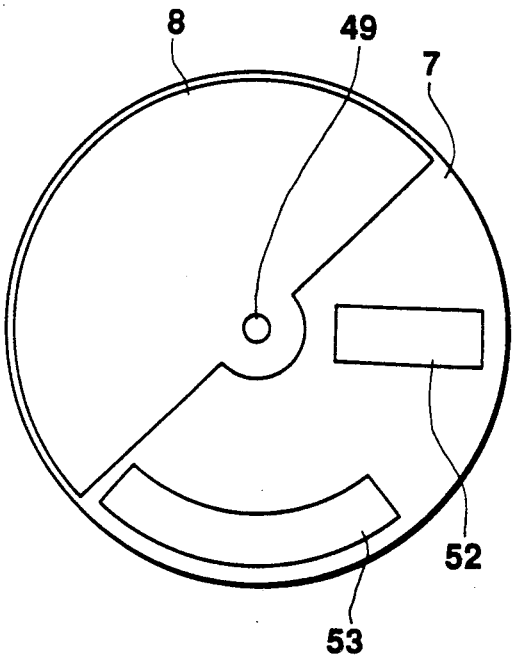
FIG. 11 is a plan view showing a shape of a shutter plate and a positional relationship between the shutter plate and display openings of a dial plate in another modification of the first embodiment of the invention.
Figure 12:
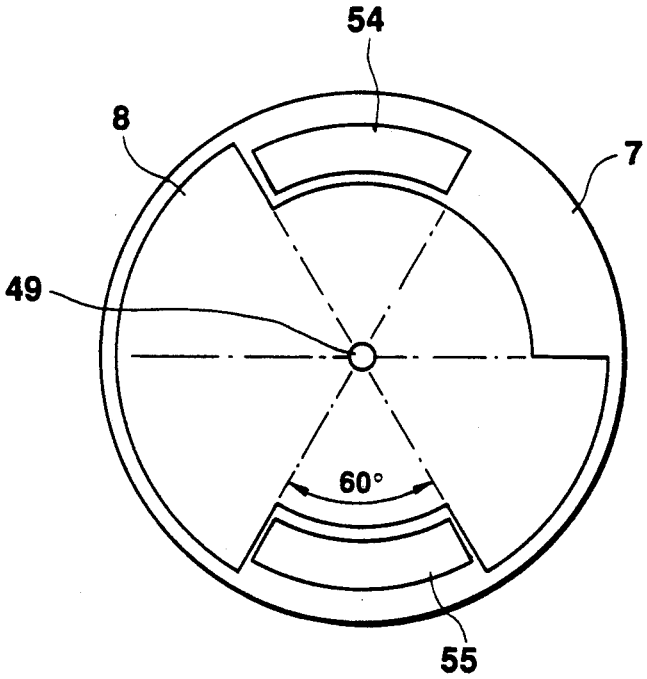
FIG. 12 is a plan view showing a shape of a shutter plate and a positional relationship between the shutter plate and display openings of a shutter plate in still another modification of the first embodiment of the invention.

It may be needless to say that the present invention is not limited to the above embodiment and various modifications can be made without departing from the scope of the invention. For instance, the arrangement of two display window portions of the dial plate and the shape of the shutter plate may be so modified as shown in FIGS. 10 through 12. In FIG. 10, two display window portions 50, 51 are formed on the six o'clock line with departing from each other in a radial direction, each having a width-wide circular arc with a central angle of slightly smaller than 90° around the pivotal center 49 of the hands. Two electric-optical display devices are arranged below the display window portions 50, 51. The shutter plate 8, on the other hand, is constructed by four sector shaped portions 8P, 8Q, 8R and 8S, each having a central angle of 90° around the pivotal center of the hands. The sector shaped portion 8P has an outer peripheral edge the radius of which is smaller than that of an inner peripheral edge of the inner display window portion 50, and the sector shaped portion 8Q has an outer peripheral edge the radius of which is greater than that of an outer peripheral edge of the outer display window portion 51, while the sector shaped portion 8R has an outer peripheral edge the radius of which is greater than that of an outer peripheral edge of the inner display window portion 50 but smaller than that of an inner peripheral edge of the outer display window 51, and the sector portion 8S has an outer peripheral edge the radius of which is greater than that of the outer peripheral edge of the display window portion 51 and is provided with a width-wide circular arc shaped opening portion 8*t*. This opening portion 8*t* is slightly larger than the inner display window portion 50 and has the same radial distance from the pivotal center 49 of the hands as that of the inner displaying window portion 51.

Thus, when the sector portion 8P is placed just inside the display window portion 50 as shown in FIG. 10, both of the display window portions 50, 51 are opened. When the shutter plate 8 is rotated in the forward direction (clockwise) by 90° from the above position, both of the display window portions 50, 51 are closed by the sector portion 8Q. When the shutter plate 8 is further rotated in the forward direction (clockwise) by another 90°, only the inner display window portion 50 is closed by the sector portion 8R but the outer display window portion 51 is opened. When the shutter plate 8 is rotated in the forward direction (clockwise) further by another 90°, the sector portion 8S comes above the outer display window portion 51 to close it but the inner display window portion 50 is fully opened as the width-wide circular shaped opening portion 8t overlaps it.

The dial plate 7 as illustrated in FIG. 11 is provided with a side-widely rectangular shaped display window 52 on the three o'clock line, a width-wide circular arc shaped display window portion 53 on the six o'clock line, and electric-optical display devices are mounted below the display window portions 52, 53. The display window portions 52, 53 have such shapes and positional relationship between them that they are fully closed by sector shaped portion separated from each other by a predetermined distance in a circular direction and having a center angle of smaller 180° around the pivotal center of the hands. In other words, the shutter plate has a semicircular shape having a radius slightly greater than that of the outer peripheral edge of the width-wide circular arc shaped display window portion 53 and is rotatable around the pivotal center of the hands. With such construction, both or either of the display window portions 52, 53 may be closed or opened by appropriately selecting a rational position of the shutter plate 8.

On the other hand, the dial plate 7 as shown in FIG. 12 is provided with a width-wide circular arc shaped display window portions 54, 55 arranged on the twelve o'clock line and the six o'clock line, each of the window portions having a central angle of slightly smaller than 60° and the same radial distance from the center of the dial plate 7 as each other. The shutter plate 8 is provided with a pair of portions which are arranged oppositely relative to the center of the shutter plate, and each of which have a central angle of 60° and have an outer peripheral edge smaller in the radial size than the inner peripheral edge of each of the display window portions 54, 55. Besides, the shutter plate 8 also has another pair of portions which are arranged oppositely relative to the center of the shutter plate 8, and each of which have a central angle of 60° and have an outer peripheral edge slightly greater in the radial size than the outer peripheral edge of each of the display window portions 54, 55, and still another pair of portions which are arranged oppositely relative to the center of the shutter plate 8, one of the portions having a central angle of 60° and an outer peripheral edge slightly smaller in the radial size than the inner peripheral edge of each of the display window portions 54, 55, the other portion having a central angle of 60° and an outer peripheral edge slightly greater in the radial size than the outer peripheral edge of each of the display window portions 54, 55. With such construction, both or either of the display window portions 54, 55 may be closed or opened by appropriately selecting the rotational angle of the shutter plate 8.

Figure 13:
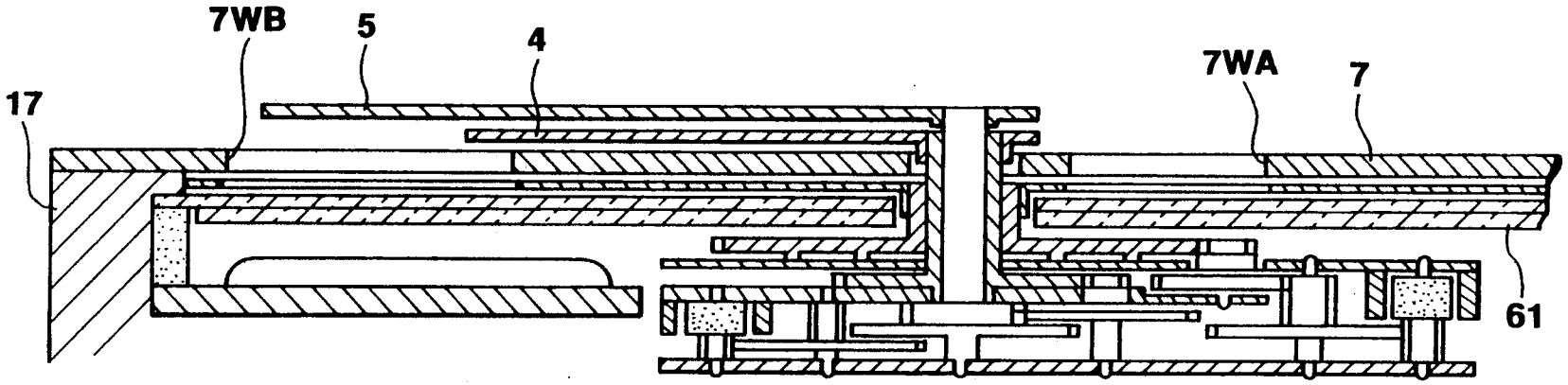
FIG. 13 is a sectional view of an electronic wrist watch of the another modification of the first embodiment of the invention.

While the above embodiment is provided with two electric-optical display devices (or liquid crystal display panels) which are respectively arranged below the corresponding display window portions, they may be replaced by a single electric-optical display device 61 as shown in FIG. 13 and an information or informations may be displayed a portion or portions on the display device which corresponds or correspond to an opened window portion or opened window portions.

(2) 2nd Embodiment

Now, a second embodiment of the invention will be described by referring to FIGS. 14 through 20.

This embodiment have only the hour and minute hands but does not have the second hand. And when the current date is displayed in the date display mode, one of two display window portions 7WA, 7WB of the dial plate 7 above which the hands are not located is opened to display the date on the liquid crystal display panel under the opened window portion. The date may be readily visible because it is not obstructed by the hands. When the two display window portions 7WA, 7WB are opened and an alarm time and an alarm message are displayed on the two liquid crystal display panels 10*a*, 10*b* in the alarm display mode, the hands are forcibly moved away from the display window portions 7WA, 7WB to make the hands not cover the window portions.

(a) Construction

The construction of this second embodiment is different from that of the above describe first embodiment in that, the second embodiment has only the minute hand and the hour hand while the first embodiment has three hands, or the second hand, the minute hand and the hour hand. Therefore, the gear train mechanism 15 does not have a mechanism for driving the second hand. However, the constructions of the shutter plate 8 and the shutter opening/closing device 16 are substantially the same as those of the first embodiment, therefore they will not be described here.

Figure 14:
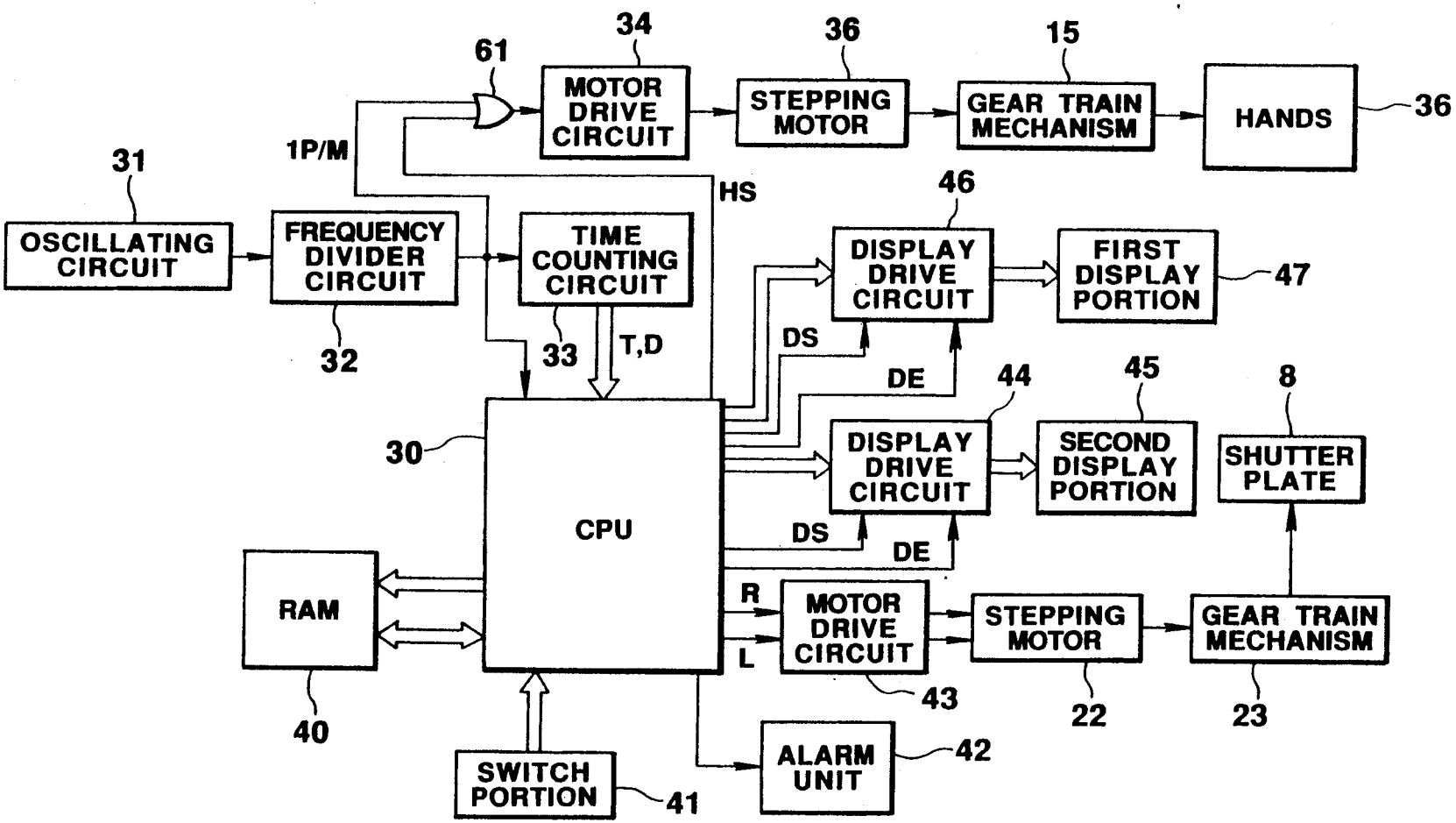
FIG. 14 is a block diagram showing a circuit struction of an electronic wrist watch of a second embodiment of the invention.

FIG. 14 shows the circuit construction of the second embodiment, which differs from that of the first embodiment. Since this embodiment has only the minute hand and the hour hand, one-minute signals (1 P/M) are supplied from the frequency divider circuit to the motor drive circuit 34 by way of the OR-gate 61. Besides, rapid forwarding signals HS are supplied from the CPU 30 to the motor drive circuit 34 by way of the OR gate 61 in order to forcibly move the hands to a predetermined position in the alarm display mode and to bring back to their rightful positions when the alarm display mode is terminated. The one-minute signals (1 P/M) outputted from the frequency divider circuit are also supplied to the CPU 30.

While the shutter plate 8 of the first embodiment can rotate only in the forward direction (counterclockwise), the shutter plate 8 of this second embodiment can rotate both in the forward (clockwise) and reverse (counterclockwise) directions. That is, the stepping motor 22 rotates in the forward direction (counterclockwise) to rotate the shutter plate 8 in the forward direction (counterclockwise) when a forward (counterclockwise) rotation signal L is supplied from the CPU 30 to the motor drive circuit 43, whereas the stepping motor 22 rotates in the reverse direction (clockwise) to turn the shutter plate 8 in the reverse direction (clockwise) when a reverse (clockwise) rotation signal R is supplied from the CPU 30 to the motor drive circuit 43.

The RAM 38 of this embodiment further has, beside the register of the RAM of the first embodiment, a hand position register H, which stores the current positions of the hands.

This embodiment does not have a stopwatch function and therefore does not have the stopwatch circuit as in the case of the first embodiment.

(b) Operation

Figure 15:
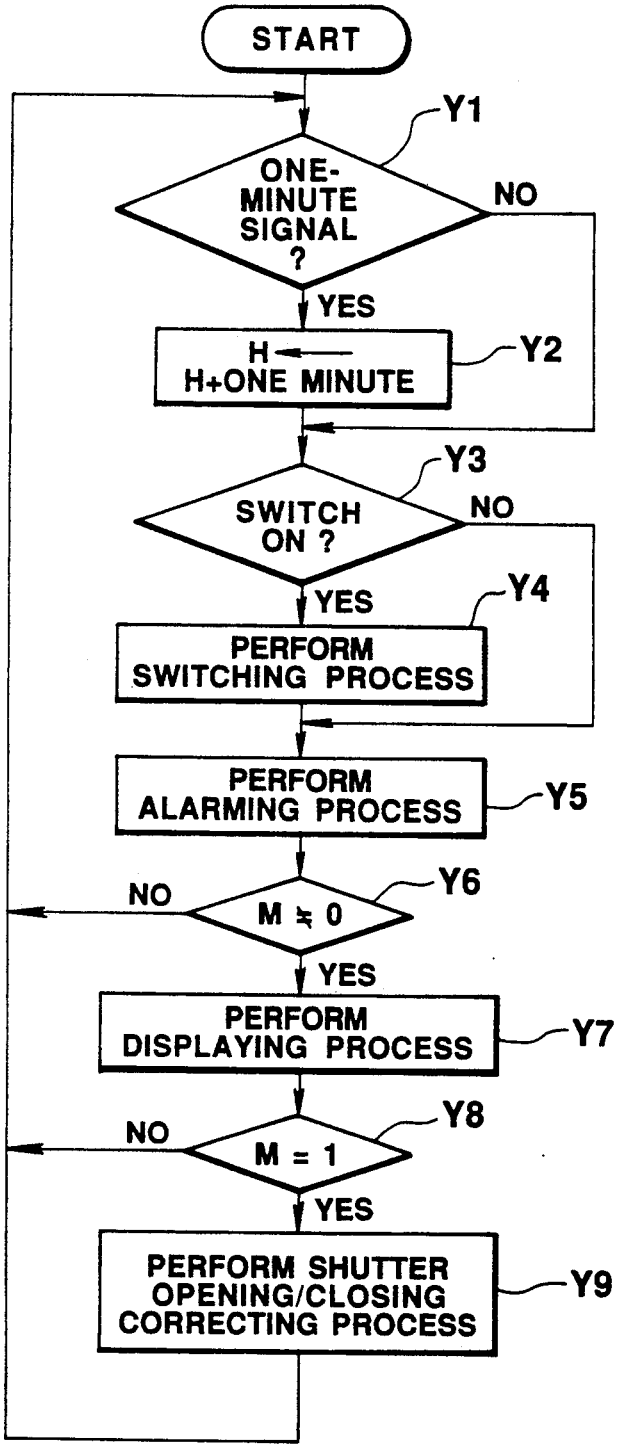
FIG. 15 is a general flowchart illustrating an action of the circuit of FIG. 14.

The second embodiment acts in the following manner. FIG. 15 is a general flow chart illustrating the overall action of this second embodiment. In a step Y1, the CPU 30 checks if there is a one-minute signal sent from the frequency divider circuit 32 or not. If yes, the action proceeds to a step Y2, where a time in a hand position register H is increased by one minute and then goes to a step Y3. If, on the other hand, it is determined in the step Y1 that there is no one-minute signal transmitted from the frequency divider circuit 32, the action goes directly to the step Y3. In the step Y3, the CPU 30 checks if a signal representing that a switch is depressed has been sent or not. If yes, the action proceeds to a step Y4, where a corresponding switching process is carried out. If it is found in the step Y3 that there is no signal representing the fact that a switch is depressed, the action proceeds directly from the step Y3 to a step Y5, where it is determined if the current time T from the timer counting circuit 33 has reached the alarm time stored in the alarm time memory AT or not. If the current time has reached the stored alarm time, the CPU 30 sends a signal to the alarm unit 42 to make it generate an alarm sound. Thereafter, in a step Y6, if the value in the mode register M is other than 0 or not, or a mode other than the watch mode is selected or not, is checked. If it is determined that the value is equal to 0 and the watch mode is selected, the action returns to the step Y1, whereas the action goes to a step Y7 in a mode any other than the watch mode to carry out the displaying process for displaying information specified to be displayed on the liquid crystal display panel 10*a* and etc. After completion of the displaying process in the step Y7, the CPU 30 checks if the value in the mode register M is set to 1 or not, or the date display mode is selected or not. The action returns directly to the step Y1 in a mode other than the date display mode, whereas it returns to the step Y1 after the CPU 30 carries out a shutter opening/closing correcting process in the date display mode.

Figure 16:
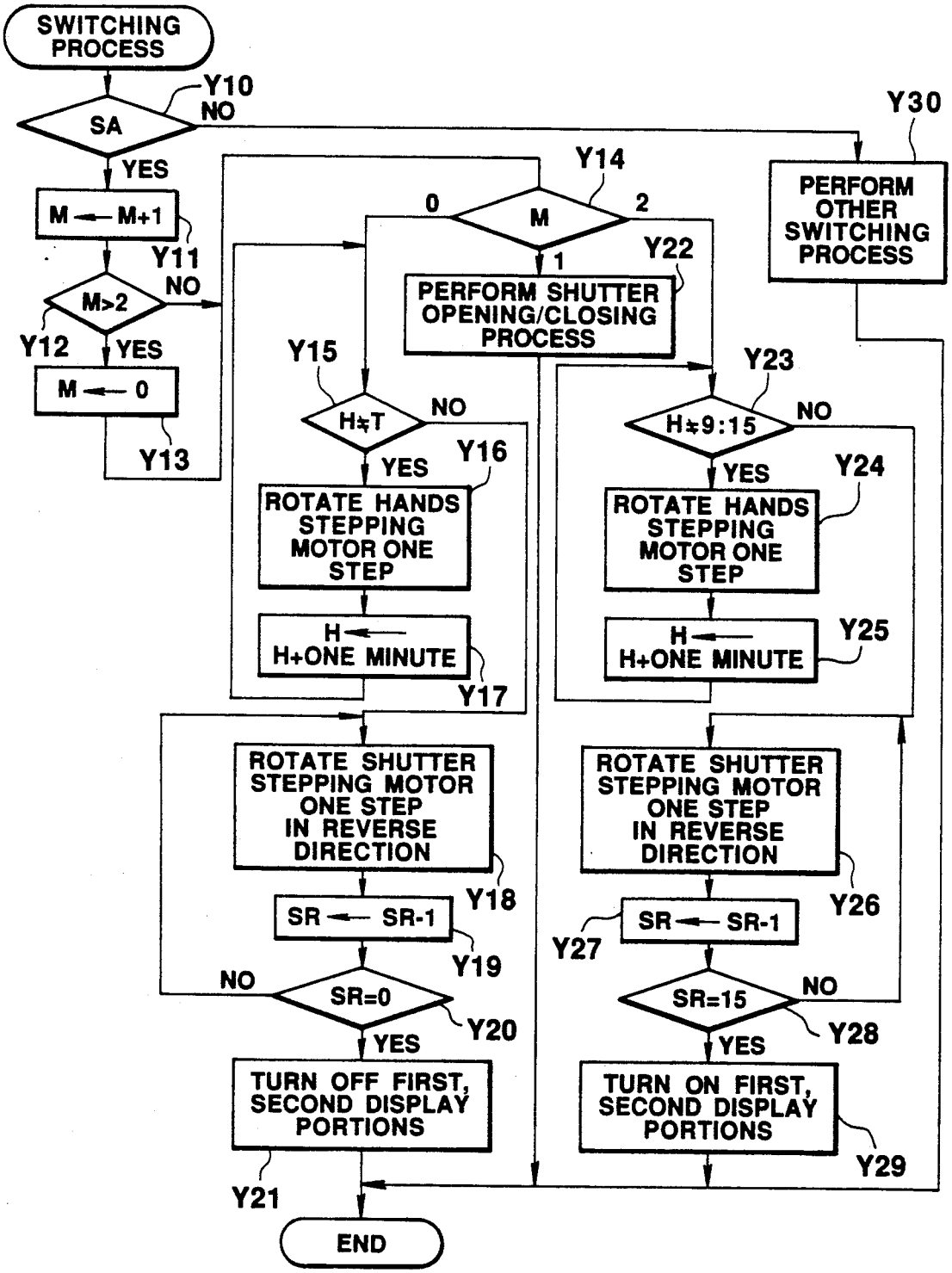
FIG. 16 is a flow chart illustrating in detail a switching process in the flowchart of FIG. 15.
Figure 17:
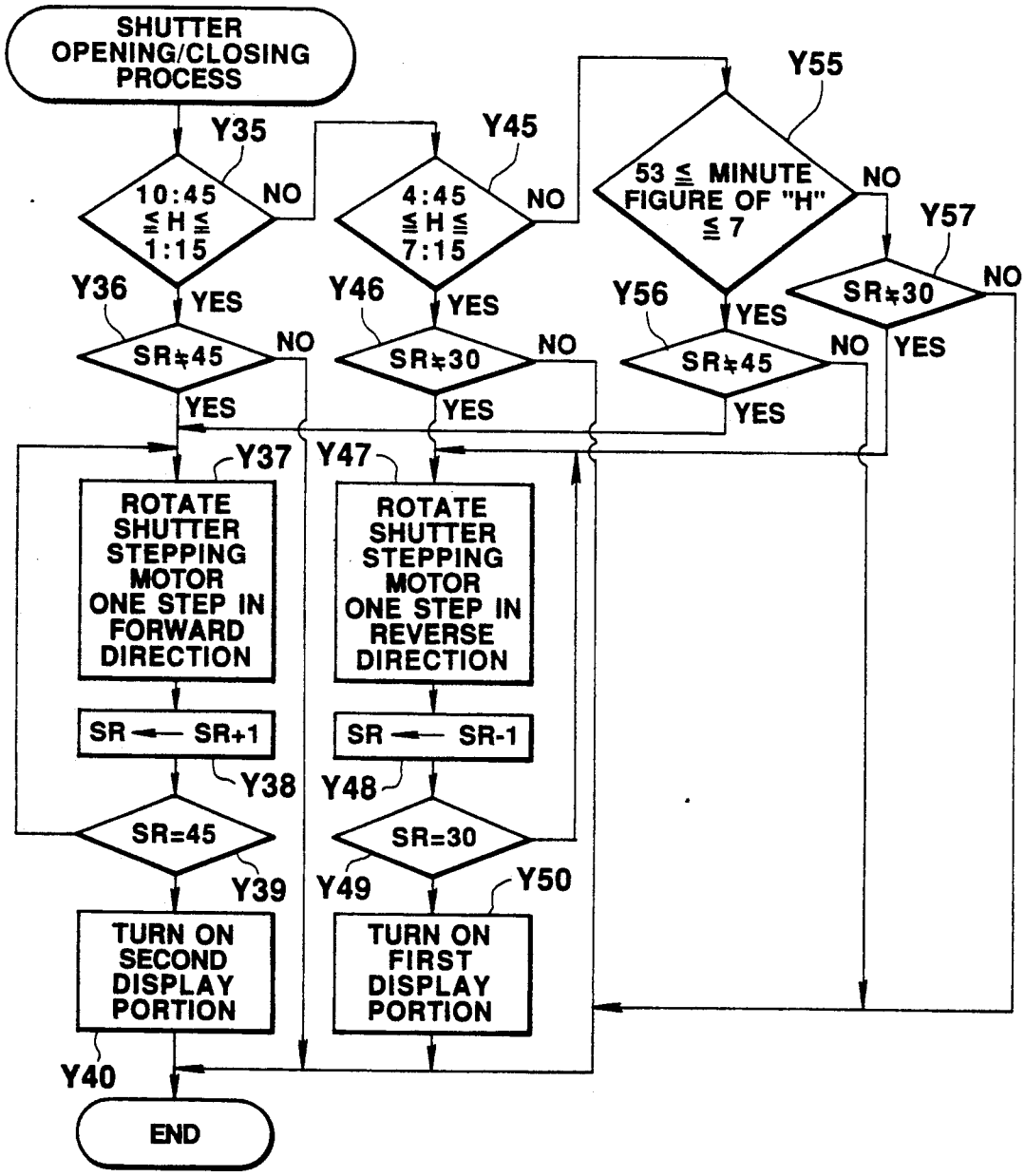
FIG. 17 is a flow chart illustrating in detail a shutter opening/closing process in the flowchart of FIG. 16.
Figure 18:
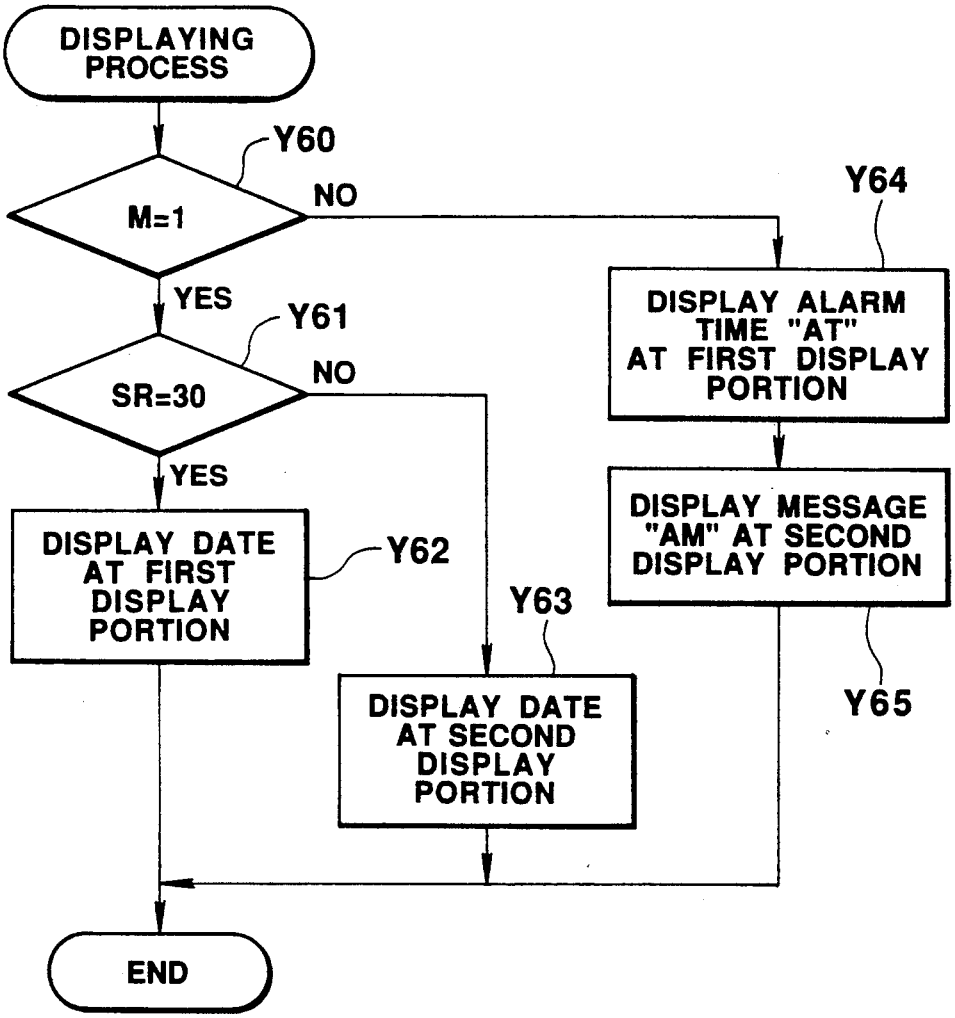
FIG. 18 is a flow chart illustrating in detail a displaying process in the flowchart of FIG. 15.
Figure 19:
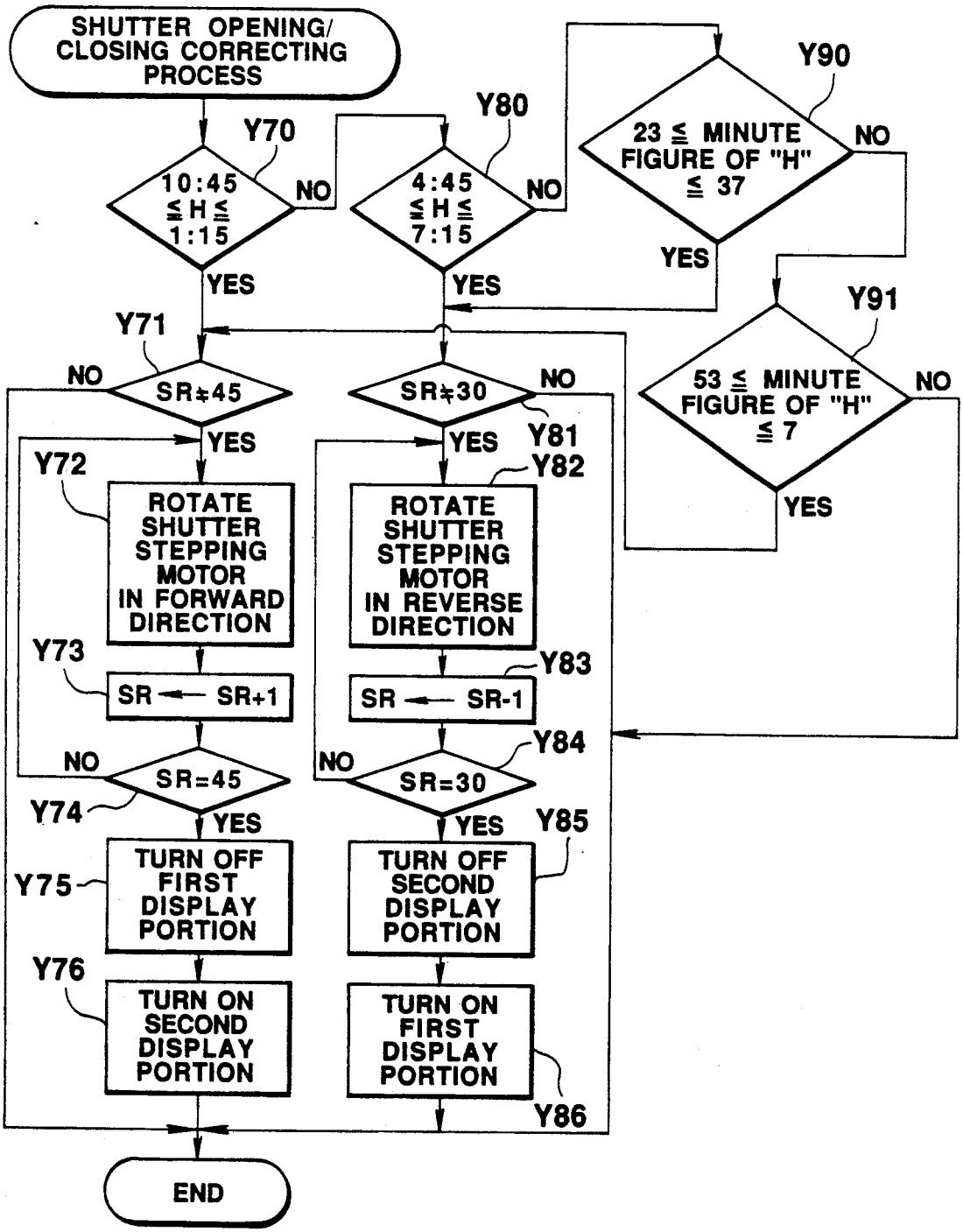
FIG. 19 is a flowchart illustrating in detail a shutter opening/closing correction process in the flow chart of FIG. 15.
Figure 20A:
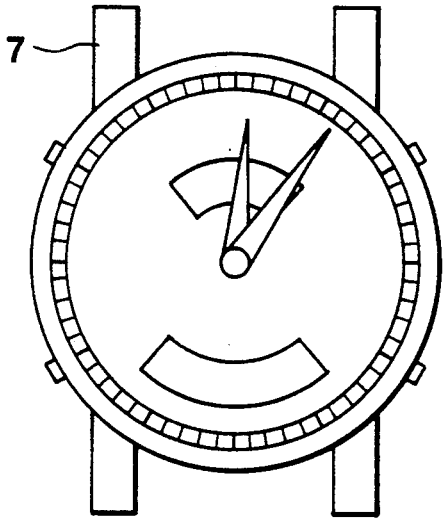
FIG. 20A is a plan view of the second electronic wrist watch of the second embodiment with its two openings of a dial plate being closed by a shutter plate.
Figure 20B:
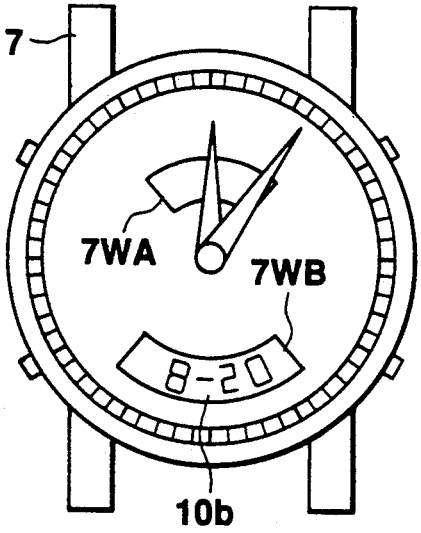
FIG. 20B is a plan view of the electronic wrist watch of the second embodiment with only one of the openings being opened and the other opening being closed by the shutter plate.
Figure 20C:
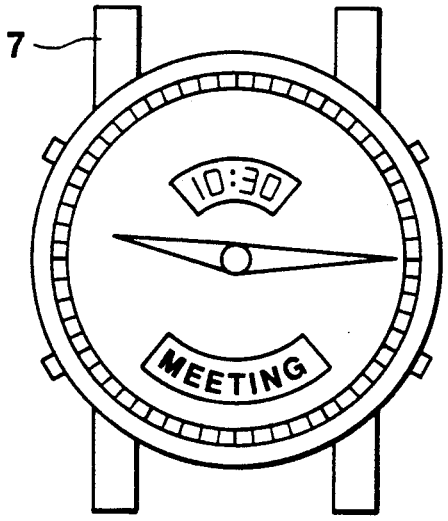
FIG. 20C is a plan view of the electronic wrist watch of the second embodiment with both of the two openings being opened.

FIG. 16 is a flow chart illustrating in detail the switching process (the step Y4) in the chart of FIG. 15, and FIG. 17 is a flow chart illustrating in detail the shutter opening/closing process of FIG. 16. FIG. 18 is a flow chart illustrating in detail the displaying process in the chart of FIG. 15, FIG. 19 is a flow chart illustrating in detail the shutter opening/closing correcting process, and FIGS. 20A through 20C show the change in the appearance of the embodiment in accordance with the change in the modes of action. The action of the embodiment in various conditions will be described in detail below by referring to these drawings.

(I) Action in the watch Mode

Assume that 0 is set in the mode register M and the watch mode is selected. Then, unless any of the switches is depressed, the time in the hand position register H is advanced by one minute at each time it detects a one-minute signal (in the steps Y1 and Y2) and, after the step S3, the alarming process in the step Y5 is executed in a manner as described above. Then, in the step Y6, it determines that 0 is set in the mode register M and the watch mode is selected and, thereafter, the action returns to the step Y1 to repeat the above procedures. Eventually, 0 is set in the shutter position register SR and both of the display window portions 7WA, 7WB are closed by the shutter plate 8 so that the embodiment takes an appearance as illustrated in FIG. 20A.

Action in the Date Display Mode

The watch mode is switched to the date display mode when the push button switch SA is depressed. Then, in the step Y3, it is detected that the switch SA is turned on and the action proceeds to the step Y4 for the switching process as shown in FIG. 16. In a step Y10 of FIG. 16, it is determined that the push button switch SA is depressed and then, in a step Y11, the value in the mode register M is increased by one to set the date display mode. Thereafter, in a step Y12, that the value in the mode register does not exceed 2 yet is determined, and the action proceeds to a step Y14, where it is determined that the value in the mode register M is 1 and the date display mode is selected. Then, the action proceeds to a step Y22 for the shutter opening/closing process as illustrated in FIG. 17. For the shutter opening/closing process, it is firstly checked if the time in the hand position register H is between 10:45 and 1:15 or both of the hands 4 are found on the display window portion 7WA or not in a step Y35. If yes, the action proceeds to a step Y36, where it is checked if the value of the shutter position register SR is equal to 45 (or the notch portion 9*b* of the shutter plate 8 is exactly placed under the display window portion 7WB to open the latter) or not. If it is determined that the value in the shutter position register SR is not equal to 45, forward (counterclockwise) rotation signals R are supplied to the motor drive circuit 43 until the value in the shutter position register SR reaches 45 to make the shutter drive stepping motor 22 and therefore the shutter plate 8 rotate in the forward direction (counterclockwise) by one step and to increase the value in the shutter position register SR by one (steps Y37 through Y39). When the value in the shutter position register SR becomes 45 (and therefore the display window portion 7WB is fully opened to expose the liquid crystal display panel 10*b* located below it), it is detected the above described fact in the step Y39 and the action proceeds to a step Y40, where the display start signal DS is supplied to the display drive circuit 44 to make the liquid crystal display panel 10*b* of the second display portion 43 set in the stand-by condition for the displaying action.

When, on the other hand, it is determined in the step Y35 that the time in the hand position register H is not between 10:45 and 1:15, the action goes to a step Y45, where it is checked if the time in the hand position register H is between 4:45 and 7:15 or not, or the hands 4 are found on the display window portion 7WA or not. If yes, the action goes to a step Y46, where it is checked if the value in the shutter position register SR is equal to 30 or not (or the opening portion 9*b* of the shutter plate 8 have already placed exactly under the display window portion 7WA to open the latter or not). If it is found that the value in the shutter position register SR is already equal to 30, the shutter opening/closing process is terminated. But, if it is found that the value in the shutter position register SR is not yet equal to 30, the sending of the reverse (clockwise) rotation signals L to the motor drive circuit 43 is kept to continually rotate the shutter drive stepping motor 22 and therefore the shutter plate 8 by one step and to decrease the value in the shutter position register SR by one (step Y47 through Y49) until the value in the shutter position register SR reaches 30. When the value in the shutter position register SR becomes equal to 30 (and therefore the display window portion 7WA is completely opened to expose the liquid crystal display panel 10*a*), it is detected in the step Y49 and the action goes to a step Y50, where the display start signal DS is transmitted to the display drive circuit 42 to make the liquid crystal display panel 10*a* of the first display portion 47 set in the stand-by condition for the displaying action.

When, on the other hand, it is determined in the step Y45 that the time in the hand position register H is not between 4:45 and 7:15, the action proceeds to a step Y55, where it is checked if the number for minute of the time in the hand position register H is between 53 to 07 or not. If yes, the action proceeds to a step Y56, where it is checked if the value in the shutter position register SR is already equal to 45 or not. If it is determined that the value is already equal to 45, the shutter opening/- closing process is terminated, whereas, if it is found that the value in the shutter position register SR is not equal to 45 yet, the processes of the steps Y37 through Y40 are carried out to open the display window portion 7WB to expose the liquid crystal display panel 10*b* and make it set in the standby condition for the displaying action.

Upon completion of the shutter opening/closing process (of FIG. 17 and therefore in the step Y22 of FIG. 16), the switching process of FIG. 16 is terminated and the action goes to the step Y5 of FIG. 15, where the alarming process is carried out in a manner as described earlier, and then to the step Y6, where it is determined that the value in the mode register M is not equal to 0 and therefore the watch mode is not set. Thereafter, the action goes to the step Y7 for the displaying process as illustrated in detail in FIG. 18. In a step Y60, it is determined that the value in the mode register M is equal to 1 and the date display mode is selected and then, in a step Y61, it is checked if the value in the shutter position register SR is already equal to 30 or not, that is more, specifically if the display window portion 7WA is opened because the value in the shutter position register SR is 30 due to the completion of the shutter opening/-closing process as described above or not, and if the display window portion 7WB is opened because the value in the shutter position register SR is 45 or not. If Yes, the action goes to a step Y62 to display the current date D on the liquid crystal display panel 10*a* of the first display portion 45 which is already set in the stand-by condition for the displaying action. If not, on the other hand, the action goes to a step Y 63, where the current date is displayed on the liquid crystal display panel 10*b* of the second display portion 43 which is already set in the stand by condition for the displaying action. Thus, the display window portion 7WB is opened to display the current date (August 20th) on the liquid crystal display panel 10*b* if the hands 4 are found on the display window portion 7WA as shown in FIG. 20B and the value in the shutter position register SR is equal to 45.

After completing the displaying process, the action goes to a step Y8 of FIG. 15, where it is determined that 1 is set in the mode register M to select the date display mode and then to a step Y9 for the shutter opening/-closing correcting process as illustrated in FIG. 19. This process is so designed that one of the liquid crystal display panels 10*a*, 10*b* being covered by the hands (that is, not hardly to the visible) is selected and the data is displayed on the above described one liquid crystal display panel. As the time goes on, the hands are moved and they may come above the liquid crystal display panel on which the current date is displayed. Then, if such a condition is detected, the date displayed on the liquid crystal display panel is moved to the other liquid crystal display panel which is now free from the hands.

More specifically, in a step Y70, it is checked if the time of the hand position register H is between 10:45 and 1:15 or not (and therefore if the hands are found above the display window portion 7WA or not). If the time in the hand position register H is between 10:45 and 1:15, then the action goes to a step Y71, where it is checked if the value in the shutter position register SR is equal to 45 and therefore only the display window portion 7WB is opened or not. If the value in the shutter position register S is already equal to 45, the shutter opening/closing correcting process is terminated, whereas the forward (counterclockwise) rotation signal R is transmitted to the shutter drive stepping motor 22 to make the shutter plate 8 rotate in the forward direction (counterclockwise) by one step and the value in the shutter position register SR is increased by one. These processes are repeated until the value in the shutter position register SR becomes equal to 45 (in steps Y72 through y74). When the value in the shutter position register SR becomes equal to 45 and therefore the display window portion 7WA is closed while the display window portion 7WB is opened to expose the liquid crystal display panel 10*b*, this condition is detected in the step Y74 and the action goes to a step Y75, where the displaying action on the liquid crystal display panel 10*a* of the first display portion is terminated, and then to a step Y76, where the liquid crystal display panel 10*b* of the second display portion 43 is set in the stand-by condition for the displaying action. Thereafter, the shutter opening/closing correcting process is terminated.

If it is determined in the step Y70 that the time in the hand action register H is not between 10:45 and 1:15, then the action proceeds to a step Y80, where it is checked further if the time in the hand position register H is between 4:45 and 7:15 (and therefore the hour hand 4 is found above the display window portion 7WB) or not. If the time in the hand position register H is between 4:45 and 7:15, the action goes to a step Y81, where if the value in the shutter position register SR is already equal to 30 and only the display window portion 7WA is opened or not. If it is found here that the value in the shutter position register SR is already equal to 30, the shutter opening/closing correcting process is terminated, whereas, if the value is not equal to 30 yet, the reverse (clockwise) rotation signal L is transmitted to the shutter drive stepping motor 22 to rotate the shutter plate 8 by one step and the value in the shutter position register SR is decreased by one. The processes (steps Y82 through Y84) are repeated until the value in the shutter position register SR becomes equal to 30. When the value in the shutter position register SR becomes equal to 30 and therefore the display window portion 7WB is closed while the other display window portion 7WA is opened to expose the liquid crystal display panel 10*a*, it is detected in the step y84 and the action goes to a step Y85, where the displaying action on the liquid crystal display panel 10*b* of the second display portion 43 is terminated. Then, in a step Y86, the liquid crystal display panel 10*a* of the first display portion 45 is set in the standby condition for the displaying action and the shutter opening/closing correcting process is terminated.

If the time in the hand position register H is not found between 4:45 and 7:15 in the step Y80, the action goes to a step Y90, where it is checked if the number for minute of the time in the hand position register H is between 23 and 37 and therefore the minute hand 5 is found above the display window portion 7WB or not. If yes, the shutter plate 8 is rotated reversely (clockwise) to open the display window portion 7WA and the liquid crystal display panel 10*a* is set in the stand-by condition for the displaying action until the value in the shutter position register SR becomes equal to 30, provided that the processes of the steps Y81 through Y86 has not been executed and therefore the value in the shutter position register SR has not reached 30 to set the liquid crystal display panel 10*a* in the stand by condition for the displaying action.

If it is found in the step Y90 that the number for minute of the time in the hand position register H is not between 23 and 37, the action goes to a step Y91, where if the number for minute of the time in the hand position register H is between 53 and 07 and therefore the minute hand is found above the display window portion 7WA or not is checked. If it is found that the number for minute of the time in the hand position register H is not between 53 and 07, the shutter opening/closing correcting process is terminated. If it is found that the number for minute of the time is between 53 and 07, the shutter plate 8 is rotated forwardly (counterclockwise) to open the display window portion 7WB and to make the liquid crystal display panel 10*b* set in the stand-by condition for the displaying action until the value in the shutter position register SR becomes equal to 45, provided that the processes of the steps Y71 through Y76 have not been executed and therefore the value in the shutter position register SR has not reached 45 not to set the liquid crystal display panel 10*b* in the date displaying condition.

It may be needless to say that the shutter opening/-closing correcting process is terminated immediately if it is determined in the step Y91 that the number for minute of the time in the hand position register H is not between 53 and 07.

When the shutter opening/closing correcting process or the process of the step Y9 of FIG. 15 is carried out, the action returns to the step Y1 to go through the processes of the steps Y1 through Y6. Then, the displaying process (in the step Y7 or the process of FIG. 18) is carried out to display the current date on either of the liquid crystal display panel which is set in the stand-by condition for the displaying action (the steps Y60 through Y63).

(III) Action in the Alarm Data Display Mode

The date display mode is switched to the alarm data display mode by depressing the push button switch SA. Then, the depressed condition of the push button switch SA is detected in the step Y10 of FIG. 16 and, in the step Y11, the value in the mode register M is increased by one to become 2 and the alarm data display mode is selected. Then, after passing the steps Y12 and Y14, it is checked in a step Y23 if the time in the hand position register H is 9:15 and therefore the hands 37 are pointing at 9:15 or not. (If the hands 37 are pointing at 9:15, they are not found above either of the display window portions 7WA, 7WB.) If it is found that they are not pointing at 9:15, the quick advance signals HS are transmitted to the motor drive circuit 34 by way of the OR-gate 61 to cause the stepping motor 36 to advance the hands 36 by one minute at each time it receives the quick advance signal HS, then the time in the hand position register H is increased by one minute until the hands come to point at 9:15 (the step Y23, and steps Y24 and Y25). When the hands 37 come to point at 9:15, the action goes from the step y23 to a step Y26, where the reverse rotation signal L is transmitted to the shutter drive stepping motor 22 to rotate reversely (clockwise) the shutter plate 8 by one step, and the value in the shutter position register SR is decreased by one until the value in the shutter position register SR becomes equal to 15 and therefore both of the display window portions 7WA, 7WB are opened to expose the liquid crystal display panels 10*a*, 10*b* (the step Y26, and the steps Y27 and Y28). When the value in the shutter position register SR becomes equal to 15, the action goes from the step Y28 to a step Y29, where both of the liquid crystal display panels 10*a*, 10*b* of the first and second display portions 47, 45 are set in the stand-by condition for the displaying action. Thereafter, the action proceeds to the step Y5 of FIG. 15, where the alarming process is carried out in the manner as described earlier and it is determined that the value in mode register M is not equal to 0 and therefore the watch mode is not selected before the action proceeds to the displaying process (the step Y7 or the process of FIG. 18). For the displaying process, it is firstly determined in the step Y60 that the value in the mode register M is not equal to 1 and therefore the current mode is not the date display mode. Then, in a step Y64, the alarm time stored in the alarm message memory AT of the alarm information storage portion A is displayed on the liquid crystal display panel 10*a* of the first display portion 47 and, in a step Y65, the message stored in the alarm message memory AT of the alarm information storage portion A is displayed on the liquid crystal display panel 10*b* of the second display portion 45. Thus, if the alarm information storage portion A stores an information for a meeting starting at 10:30, the liquid crystal display panels 10*a*, 10*b* will appear as shown in FIG. 20C.

After completing the displaying process, the action goes from the step Y7 to the step Y8 of FIG. 15, where it is determined that the value in the mode register M is not equal to 1 and therefore the date display mode is not set, and then the action returns to the step Y1.

After displaying the alarm data in the alarm data display mode, the mode of action can be returned to the watch mode by depressing the push button switch SA. The condition that the push button switch S is depressed is detected in the step Y10 of FIG. 16 and, in the step Y11, the value in the mode register M is increased by one to become equal to 3. Then, in the step Y12, it is determined that the value in the mode register M exceeds 2 and, in a step Y13, the value in the mode register M is set to 0 to select the watch mode. Thereafter, in the step Y14, it is determined that the value in the mode register M is already equal to 0 and the watch mode is selected, and the action proceeds to a step Y15, where it is checked if the time in the hand position register H is coincident with the current time T obtained from the time counting circuit 33 or not (and therefore if the hands 37 indicate the current time or not). If yes (and therefore the hands indicate the current time), the action goes directly to a step Y18. If it is found in the step Y15 that the time in the hand position register H does not coincident with the current time T, quick advance signals HS are transmitted to the stepping motor 36 to move the hands 37 by one minute at each time it receives the quick advance signal HS and then the time in the hand position register H is increased by one minute until the time in the hand position register H is coincident with the current time (the step y15, and steps y16 and y17). Then, the action proceeds to the step Y18.

In the step Y18, and steps Y19 and Y20, as described earlier, the reverse (clockwise) rotation signals L are transmitted to the shutter drive stepping motor 22 to rotate reversely (clockwise) the shutter plate 8 by one step, and the value in the shutter position register SR is decreased by one at each time the motor receives the reverse (clockwise) rotation signal L until the value in the shutter position register SR becomes equal to 0 and therefore both of the display window portions 7WA, 7WB are closed by the shutter plate 8. When the display window portions 7WA, 7WB are completely closed, the action goes from the step Y20 to a step Y21, where the information displayed on the liquid crystal display panel 10*a* of the first information portion 47 and on the liquid crystal display panel 10*b* of the second information display portion 45 are wiped out. Thereafter, the action proceeds from the step Y4 to the step Y5 of FIG. 15, where the alarming process is carried out in a manner as described earlier, and then to the step Y6, where it is determined that 0 is set in the mode register M and the watch mode is selected, and the action returns to the step Y1. Then, the embodiment will appear as shown in FIG. 20A.

In each of the above embodiments, the electric-optical display devices arranged below the openings of the dial plate so that the electric-optical display devices become visible when the shutter plate is appropriately rotated. However, in place of the electric optical display device, a display plate on which an information is fixedly displayed, such as a time difference display plate on which the time differences among the nations in the world are printed and a calendar display plate on which a monthly calendar is printed may be arranged under the openings of the dial plate.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An analog electronic timepiece comprising:

a dial plate in which at least two openings are formed;

time-indicating hand means for pivotally moving hands on said dial plate to indicate the time;

at least two electric-optical display means mounted below said dial plate to correspond to the openings;

a single shutter plate rotatably mounted between said dial plate and said electric-optical display means; and shutter-plate movement control means for controlling said single shutter plate to move it to a desired position including first, second, and third positions in its rotational direction;

wherein said single shutter plate is formed in such a shape that it opens all the openings of said dial plate when said shutter plate is located at its first position in its rotational direction, closes all the openings of said dial plate when said shutter plate is located at its second position in its rotational direction, and opens at least one of the openings and also closes at least one of the remaining ones of the openings when said shutter plate is located at its third position in its rotational direction.

2. An analog electronic timepiece according to claim 1, wherein a plurality of hour markers are formed on a circular peripheral line of said dial plate having a center at a pivotal center of the hands, one opening of the at least two openings is formed by cutting out a part of said dial plate on the circular peripheral line, and at least one of the hour markers is formed on the surface of said shutter plate at its portion to mask the above described one opening.

3. An analog electronic timepiece according to claim 1, wherein an electric-optical display device is arranged below said dial plate, and the at least two openings are so arranged to expose a part of said electric-optical display device.

4. An analog electronic timepiece according to claim 1, wherein said shutter plate is rotatably mounted around a pivotal center of said hands.

5. An analog electronic timepiece according to claim 1, wherein said timepiece further comprises display control means for activating all of said at least two electric-optical display means when said shutter plate is moved to the first position by said shutter-plate movement control means, for deactivating all of said at least two electric-optical display means when said shutter plate is moved to the second position by said shutter-plate movement control means, and for activating at least one of said at least two electric-optical display means and also deactivating at least one of the remaining ones of said at least true electric-optical display means when said shutter-plate is moved to the third position by said shutter-plate movement control means.

6. An analog electronic timepiece according to claim 1, wherein said timepiece further comprises detection means for detecting whether the hands are placed over all of the at least two openings of said dial plate or not, and said shutter-plate movement control means have control means for moving said shutter plate to a position in which one opening, not overlapped with the hands, of said at least two openings is opened.

7. An analog electronic timepiece comprising:

a dial plate in which at least two openings are formed;

time-indicating hand means for pivotally moving hands on said dial plate to indicate the time; and a single shutter plate rotatably mounted below said dial plate; and shutter-plate movement control means for controlling the movement of said single shutter plate from first position through second position to third position;

wherein said single shutter plate is formed in such a shape that it opens all of the openings of said dial plate when said shutter plate is located at its first position in its rotational direction, closes all of the openings of said dial plate when said shutter plate is located at its second position in its rotational direction, and opens at least one of the at least two openings and also closes at least one of the remaining ones of the openings when said shutter plate is located at its third position in its rotational direction.

8. An analog electronic timepiece according to claim 7, wherein a plurality of hour markers are formed on a circular peripheral line of said dial plate having a center at a pivotal center of said hands, one opening of the at least two openings is formed by cutting out a part of said dial plate on the circular peripheral line, and at least one of the hour markers is formed on the surface of said shutter plate at its portion to mask the above described one opening.

9. An analog electronic timepiece according to claim 7, wherein said shutter plate is rotatably mounted around a pivotal center of said hands.

10. An analog electronic timepiece according to claim 7, wherein said timepiece further comprises detection means for detecting whether said hands are placed over all of the at least two openings of said dial plate or not, and said shutter-plate movement control means have control means for moving said shutter plate to a position in which one opening, not overlapped with the hands, of said at least two openings is opened.

11. An analog electronic timepiece comprising:

a dial plate in which two openings are formed;

two electric-optical display means mounted below said dial plate to correspond to the openings;

time-indicating hand for pivotally moving hands on said dial plate to indicate to the time;

a single shutter plate rotatably mounted between said dial plate and said electric-optical display means;

shutter-plate movement control means for controlling said single shutter plate to move it to a desired position including first, second, third, and fourth positions in its rotational direction; and wherein said single shutter plate is formed in such a shape that it closes both of the openings when it is located at its first position, closes one opening of the openings and also opens the other opening when it is located at its second position, opens the above described one opening of the openings and also closes the above described other opening when it is located at its third position, and opens both of the openings when it is located at its fourth position.

12. An analog electronic timepiece according to claim 11, wherein said two openings are mounted at two positions being different in a distance from a pivotal center of said hands, and said shutter plate rotates around the pivotal center of said hands.

13. An analog electronic timepiece according to claim 11, wherein said shutter-plate movement control means includes switch means for controlling the displaying and erasing information on said two electric-optical display means, and means for moving said single shutter plate to expose information displaying one or both of said electric-optical display means when the displaying state on said two electric-optical display means is changed by an operation of said switch means.

14. An analog electronic timepiece according to claim 11, wherein each of the two openings of said dial plate is shaped as a circular-arc with a central angle of approximately 90°, the openings are oppositely arranged relative to a pivotal center of the hands with different distances from the pivotal center of the hands, and said shutter plate is mounted rotatably around the pivotal center of the hands and includes four portions each having a central angle of approximately 90°, the fist portion being masked at its portions corresponding to the two openings of said dial plate, the second portion being arranged opposite to the first portion relative to the pivotal center of the hands, being masked at its portion corresponding to the outer-side opening of the two openings, and being opened at its portion corresponding to the inner-side opening, the third portion being arranged between the first portion and the second portion and being opened at its portions corresponding to the two openings, and the fourth portion being arranged opposite to the third portion relative to the pivotal center of the hands, being masked at its portion corresponding to the inner-side opening, and being opened at its portion corresponding to the outer-side opening.

15. An analog electronic timepiece according to claim 11, wherein a plurality of hour markers are formed on a circular peripheral line of said dial plate having a center at a pivotal center of the hands, one opening of the two openings is formed by cutting out a part of said dial plate on the circular peripheral line, and at least one of the hour markers is formed on the surface of said shutter plate at its portion to mask the above described one opening.

16. An analog electronic timepiece according to claim 11, wherein an electric-optical display device is arranged below said dial plate, and the two openings are so arranged to expose a part of said electric-optical display device.

17. An analog electronic timepiece according to claim 11, wherein each of the two openings of said dial plate is shaped as a circular-arc with a central angle of approximately 90°, and the openings are arranged in the same direction relative to the pivotal center of the hands with different distances from the pivotal center of the hands, and said shutter plate is mounted rotatably around the pivotal center of the hands and includes four portions each having a central angle of approximately 90°, the first portion being masked at its portion corresponding to the two openings of said dial plate, the second portion being opened at its portions corresponding to the two openings of said dial plate, the third portion being masked at its portion corresponding to the outer-side opening and being opened at its portion corresponding to the inner-side opening, and the fourth portion being masked at its portion corresponding to the inner-side opening and being opened at its portion corresponding to the outer-side opening.

18. An analog electronic timepiece according to claim 11, wherein the two openings of said dial plate are formed within a region having a central angle of 180° and are arranged on two radially different positions so that they do not overlap with each other, and said shutter plate is mounted rotatably around a center at the rotatable center of the hands and is formed to have a central angle not greater than 180° but greater than that of the two-opening formed region.

19. An analog electronic timepiece according to claim 11, wherein each of the two openings of said dial plate is shaped as a circular-arc with a central angle of approximately 60°, the openings are oppositely arranged relative to the pivotal center of the hands with the same distance from the pivotal center of the hands, and said shutter plate is mounted rotatably around a center at the pivotal center of the hands and includes six portions each having a central angle of approximately 60°, the first portion and the second portion arranged opposite to the first portion relative to the pivotal center of the hands being masked at their portions corresponding to the two openings, the third portion and the fourth portion arranged opposite to the third portion relative to the pivotal center of the hands being opened at their portions corresponding to the two openings, the fifth portion being opened at its portions corresponding to the two openings, and the sixth portion being arranged opposite to the fifth portion relative to the pivotal center of the hands and being masked at its portions, corresponding to the two openings.

20. An analog electronic timepiece according to claim 11, wherein said timepiece further comprises detection means for detecting whether the hands are placed over all of the two openings of said dial plate or not, and said shutter-plate movement control means have control means for moving said shutter plate to a position in which one opening, not overlapped with the hands, of the two openings is opened and the other opening, overlapped with the hands, is closed.

21. An analog electronic timepiece comprising:

a dial plate in which two openings are formed;

time-indicating hand means for pivotally moving hands on said dial plate to indicate the time;

a single shutter plate rotatable mounted below said dial plate; and shutter-plate movement control means for controlling said single shutter plate to move it to a desired position including first, second, third, and fourth positions in its rotational direction;

wherein said single shutter plate is formed in such a shape that it closes the two openings when said shutter plate is located at its first position in its rotational direction, closes one opening of the two openings and opens the other opening when said shutter plate is located at its second position in its rotational direction, opens the above described one opening and closes the above described other opening when the shutter plate is located at its third position in its rotational direction, and opens the two openings when the shutter plate is located at its fourth position in its rotational direction.

22. An analog electronic timepiece according to claim 21, wherein the two openings are mounted at positions having different distances from the pivotal center of the hands, and said shutter plate rotates around the pivotal center of the hands.

23. An analog electronic timepiece according to claim 21, wherein each of the two openings of said dial plate is shaped as a circular-arc with a central angle of approximately 90°, the openings are oppositely arranged relative to the pivotal center of the hands with different distances from the pivotal center of the hands, and said shutter plate is mounted rotatably around a center at the pivotal center of the hands and includes four portions each having a central angle of approximately 90°, the first portion being masked at its portions corresponding to the two openings of said dial plate, the second portion being arranged opposite to the first portion relative to the pivotal center of the hands, being masked at its portion corresponding to the outer-side opening of the two openings, and being opened at its portion corresponding to the inner-side opening of the two openings, the third portion being arranged between the first portion and the second portion and being opened at its portions corresponding to the two openings, and the fourth portion being arranged opposite to the third portion relative to the pivotal center of the hands, being masked at its portion corresponding to the inner-side opening, and being opened at its portion corresponding to the outer-side opening.

24. An analog electronic timepiece according to claim 21, wherein a plurality of hour markers are formed on a circular peripheral line of said dial plate having a center at a pivotal center of the hands, one opening of the two openings is formed by cutting out a part of said dial plate on the circular peripheral line, and at least one of the hour markers is formed on the surface of said shutter plate at its portion to mask the above described one opening.

25. An analog electronic timepiece according to claim 21, wherein each of the two openings of said dial plate is shaped as a circular-arc with a central angle of approximately 90°, the openings are arranged in the same direction relative to the pivotal center of the hands with different distances from the pivotal center of the hands, and said shutter plate is mounted rotatably around a center at the pivotal center of the hands and includes four portions each having a central angle of approximately 90°, the first portion being masked at its portions corresponding to the two openings, the second portion being opened at its portions corresponding to the two openings, the third portion being masked at its portion corresponding to the outer-side opening of the two opening, and being opened at its portion corresponding to the inner-side opening, and the fourth portion being masked at its portion corresponding to the inner-side opening, and being opened at its portion corresponding to the outer-side opening.

26. An analog electronic timepiece according to claim 21, wherein the two openings of said dial plate are formed within a region having a central angle of 180° and are arranged on two radially different portions so that they do not overlap with each other, and said shutter plate is mounted rotatably around a center at the rotatable center of the hands and is formed to have a central angle not greater than 180° but greater than that of the two-opening formed region.

27. An analog electronic timepiece according to claim 21, wherein each of said two openings of said dial plate is shaped as a circular-arc with a central angle of approximately 60°, and the openings are oppositely arranged relative to the pivotal center of the hands with the same distance from the pivotal center of the hands, and said shutter plate is mounted rotatably around a center at the pivotal center of the hands and includes six portions each having a central angle of approximately 60°, the first portion and the second portion arranged opposite to the first portion relative to the pivotal center of the hands being masked at their portions corresponding to the two openings, the third portion and the fourth portion arranged opposite to the third portion relative to the pivotal center of the hands being opened at their portions corresponding to the two openings, the fifth portion being opened at its portions corresponding to the two openings, and the sixth portion arranged opposite to the fifth portion relative to the pivotal center of the hands being masked at its portions corresponding to the two openings.

28. An analog electronic timepiece according to claim 21, wherein said timepiece further comprises detection means for detecting whether the hands are placed over all of the two openings of the dial plate or not, and said shutter-plate control means have control means for moving said shutter plate to a position in which one opening, not overlapped with the hands, of the two openings is opened and the other opening, overlapped with the hands, is closed.

* * * * *